US009237771B2

(12) United States Patent
Paperno

(10) Patent No.: US 9,237,771 B2
(45) **Date of Patent: *Jan. 19, 2016**

(54) NECK, SPINE, AND SPINAL CORD SUPPORT DEVICE FOR NEWBORN BABY AND INFANT, AND BLANKET ASSEMBLY FOR SAME

(71) Applicant: Steven Paperno, Westlake Village, CA (US)

(72) Inventor: Steven Paperno, Westlake Village, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/605,735

(22) Filed: Jan. 26, 2015

(65) Prior Publication Data

US 2015/0128350 A1 May 14, 2015

Related U.S. Application Data

(63) Continuation-in-part of application No. 14/191,060, filed on Feb. 26, 2014, now Pat. No. 8,938,830, which is a continuation of application No. 13/793,579, filed on Mar. 11, 2013, now Pat. No. 8,671,486.

(51) Int. Cl.

| | |
|---|---|
| ***A41B 13/06*** | (2006.01) |
| ***A47D 13/00*** | (2006.01) |
| ***A47D 13/08*** | (2006.01) |
| ***A47G 9/08*** | (2006.01) |

(Continued)

(52) U.S. Cl.

CPC ..... *A41B 13/06* (2013.01); *A41B 13/065* (2013.01); *A47D 13/00* (2013.01); *A47D 13/08* (2013.01); *A47G 9/083* (2013.01); *A41D 13/0512* (2013.01); *A47G 2009/006* (2013.01)

(58) Field of Classification Search

CPC ..... A47G 9/083; A47G 9/08; A47G 9/086; A47G 9/10; A47G 9/1045; A47G 9/1054; A47G 9/1063; A47G 9/1072; A47G 9/1081; A47G 9/109; A47G 2009/1018; A47D 13/02; A47D 13/08; A47D 13/083; A47D 9/00; A47D 15/00; A47D 15/001; A47D 15/005; A47D 15/008; A41B 13/06; A41B 13/065; A47C 20/027

See application file for complete search history.

(56) References Cited

U.S. PATENT DOCUMENTS

| | | | | |
|---|---|---|---|---|
| 309,678 | A | 12/1884 | Aubin | |
| D139,630 | S | 12/1944 | Wade | |
| 2,876,459 | A * | 3/1959 | Ackerson | 4/572.1 |

(Continued)

OTHER PUBLICATIONS

Notice of Allowance mailed on Oct. 16, 2015 in U.S. Appl. No. 29/448,250.

(Continued)

*Primary Examiner* — Nicholas Polito

(74) *Attorney, Agent, or Firm* — Knobbe Martens Olson & Bear, LLP

(57) ABSTRACT

An assembly for supporting an infant (e.g., newborn baby) includes a fabric body defining a pocket between an upper layer and a lower layer of the body at one end of the fabric body, the pocket accessible via an opening selectively closeable to seal the pocket. A neck, spine and spinal cord support device of a semi-rigid material is removably insertable in the pocket of the fabric body by the pocket so as to maintain the support device in a substantially fixed position within the fabric body. The support device supports the head, neck, spine and spinal cord of a newborn baby or infant when the infant is on the fabric body to inhibit injury to the infant's head, neck, spine and spinal cord. The fabric body can be a swaddle blanket and/or sleeve.

24 Claims, 29 Drawing Sheets

(51) Int. Cl.
*A41D 13/05* (2006.01)
*A47G 9/00* (2006.01)

(56) References Cited

U.S. PATENT DOCUMENTS

| | | | | |
|---|---|---|---|---|
| 3,443,066 | A | 5/1969 | Wiebel | |
| 3,667,074 | A * | 6/1972 | Emery | A47G 9/10 5/636 |
| 4,087,874 | A | 5/1978 | Callaway et al. | |
| D267,678 | S | 1/1983 | Breen | |
| 4,788,726 | A | 12/1988 | Rafalko | |
| 5,333,769 | A * | 8/1994 | Skroski | 224/158 |
| 5,546,620 | A | 8/1996 | Matthews | |
| 5,551,108 | A * | 9/1996 | Butler, III | 5/655 |
| 5,551,109 | A * | 9/1996 | Tingley et al. | 5/655 |
| D398,182 | S | 9/1998 | Smith | |
| 6,036,263 | A | 3/2000 | Gold | |
| 6,256,803 | B1 | 7/2001 | Sauerbrei et al. | |
| 6,321,403 | B1 | 11/2001 | Matthews | |
| 6,513,164 | B1 | 2/2003 | Hearns | |
| D474,637 | S | 5/2003 | Scheetz | |
| D504,045 | S | 4/2005 | Rediske | |
| 7,003,832 | B2 | 2/2006 | Wilson | |
| D523,680 | S | 6/2006 | Burke | |
| 7,076,819 | B2 | 7/2006 | Trani et al. | |
| D552,244 | S | 10/2007 | Tinsley | |
| 7,584,515 | B2 | 9/2009 | Jones et al. | |
| D610,853 | S | 3/2010 | Straub | |
| 8,032,958 | B2 | 10/2011 | Pieta et al. | |
| D650,558 | S | 12/2011 | Ruse-Petersen | |
| 8,074,312 | B2 | 12/2011 | Tullous | |
| 8,191,188 | B2 * | 6/2012 | Kaplan et al. | 5/485 |
| 8,650,685 | B1 * | 2/2014 | Ford | 5/655 |
| 8,667,631 | B2 * | 3/2014 | Coates | 5/655 |
| 8,671,486 | B1 * | 3/2014 | Paperno | 5/655 |
| 8,938,830 | B2 * | 1/2015 | Paperno | 5/655 |
| 2002/0108176 | A1 | 8/2002 | Ragen | |
| 2003/0000018 | A1 * | 1/2003 | Lanteri | A47G 9/10 5/636 |
| 2006/0010600 | A1 | 1/2006 | Kendy | |
| 2006/0042013 | A1 | 3/2006 | Madsen | |
| 2007/0062988 | A1 | 3/2007 | Kassai et al. | |
| 2007/0157392 | A1 | 7/2007 | Ragen | |
| 2008/0216246 | A1 | 9/2008 | Groves | |
| 2009/0001801 | A1 * | 1/2009 | Gold | A47D 5/00 297/452.47 |
| 2009/0007336 | A1 | 1/2009 | Kassai et al. | |
| 2010/0192305 | A1 | 8/2010 | Telegadis et al. | |
| 2010/0257653 | A1 | 10/2010 | Pitts | |
| 2010/0257654 | A1 * | 10/2010 | Waters et al. | 2/69.5 |
| 2011/0083276 | A1 * | 4/2011 | Pieta et al. | 5/655 |
| 2011/0197364 | A1 * | 8/2011 | Wadia | 5/655 |
| 2011/0197365 | A1 * | 8/2011 | Wadia | 5/655 |
| 2011/0271455 | A1 | 11/2011 | Park | |
| 2013/0333113 | A1 * | 12/2013 | Gotel et al. | 5/494 |
| 2014/0020176 | A1 | 1/2014 | Coates | |

OTHER PUBLICATIONS

International Search Report and Written Opinion mailed on Nov. 4, 2014 in PCT Application No. PCT/US14/20338.

* cited by examiner

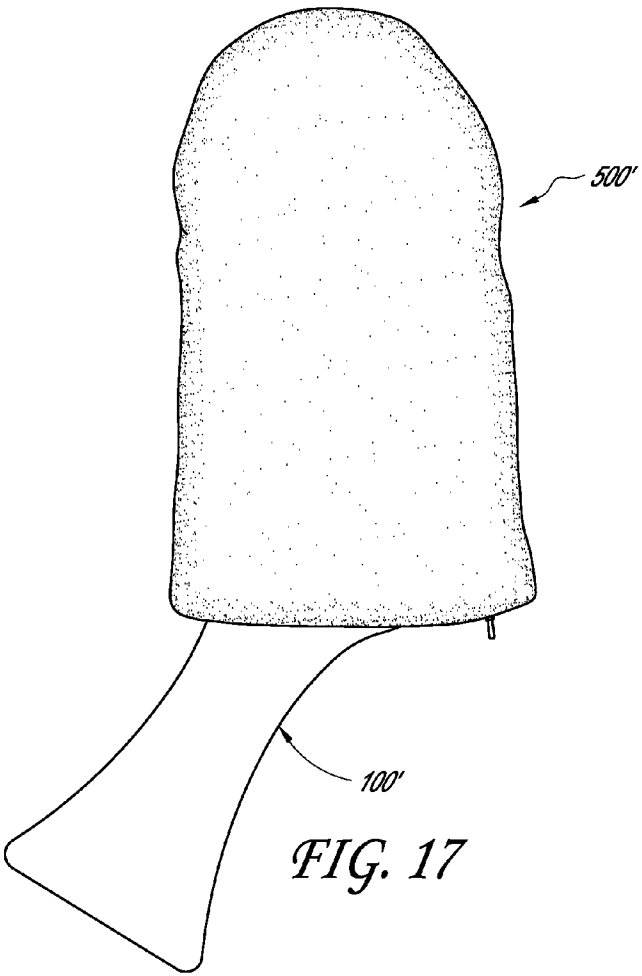
FIG. 17
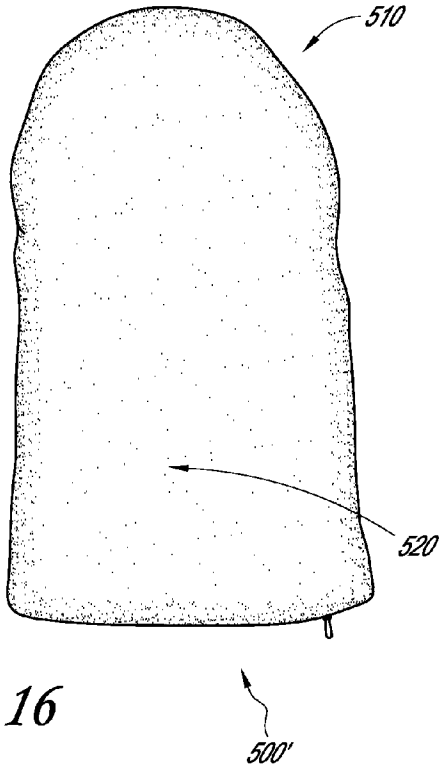
FIG. 16
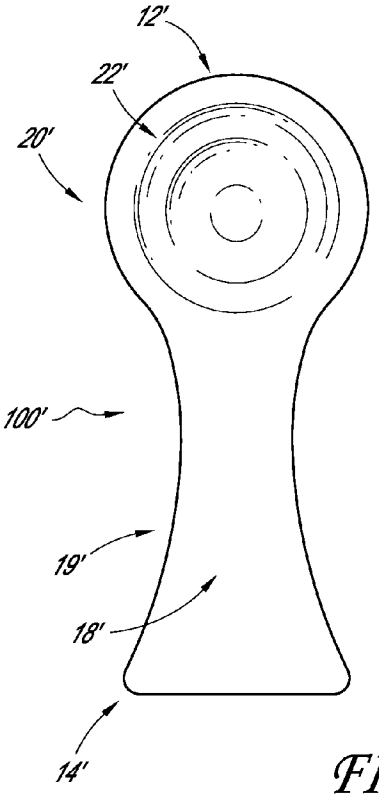

NECK, SPINE, AND SPINAL CORD SUPPORT DEVICE FOR NEWBORN BABY AND INFANT, AND BLANKET ASSEMBLY FOR SAME

INCORPORATION BY REFERENCE TO ANY PRIORITY APPLICATIONS

This application is a continuation-in-part application of U.S. application Ser. No. 14/191,060, filed Feb. 26, 2014, which is a continuation application of U.S. application Ser. No. 13/793,579, filed Mar. 11, 2013, now U.S. Pat. No. 8,671,486, all of which are hereby incorporated by reference in their entirety and should be considered a part of this specification.

BACKGROUND

1. Field

The present invention is directed to a neck, spine and spinal cord support device for a new born baby or infant, and more particularly to an assembly incorporating the support device.

2. Description of the Related Art

The body parts most susceptible to injury in an infant's body are the head, neck, spine and spinal cord, particularly in newborn babies and infants up to 6 months old. To this day there is a possibility that challenges, from learning disabilities to Autism, may be caused from injury to the spinal cord at these early stages in an infant's life. Babies rely on their care takers (e.g., parents) to hold and support their head, spine, neck and spinal cord without jarring them, all the while comforting them, swaddling them, and/or rocking them in their arms, as well as feeding them. A slight jar or jolt can possibly cause short term or long term (e.g., permanent) damage to the spinal cord, causing challenges later on in life for the child, such as learning disabilities and Autism.

New parents and others can struggle to properly hold newborn babies in a way that adequately supports the baby's head, neck, spine and spinal cord, especially when the person has not previously held newborn babies. Proper support to the head, neck, spine and spinal cord of the newborn baby is important and lack of such proper support can result in discomfort and even injury to the baby (e.g., injury to the head or spinal cord of the baby), as discussed above.

Often, people will hold the baby by holding the baby in one arm so that the baby's back (spine and spinal cord) is supported by the forearm and the baby's head and neck is supported between the person's forearm and upper arm. However, this method often does not allow the person the freedom to easily take care of other tasks with their free arm because they either use two arms to hold the baby or are nervous about maintaining proper support for the baby so that they instead opt to put the baby down (e.g., in a crib) before proceeding to handle other tasks.

Accordingly, there is a need for an improved system for ensuring proper support for the baby's head, neck, spine and spinal cord while being carried by a person, and for allowing the person to readily perform other tasks while securely carrying the baby.

SUMMARY

In accordance with one embodiment, a blanket assembly for swaddling an infant is provided. The blanket assembly comprises a blanket body defining a pocket between an upper layer and a lower layer of the body at one end of the blanket body, the pocket accessible via an opening selectively closeable to seal the pocket. The blanket assembly also comprises a neck, spine and spinal cord support device of a semi-rigid material, the support device removably insertable in the pocket of the blanket body and secured within the blanket by the pocket so as to maintain the support device in a substantially fixed position within the blanket body. The support device is configured to support the head, neck, spine and spinal cord of an infant when the infant is laid on the blanket body in a supine position and wrapped in the blanket body, and so as to inhibit injury to the infant's head and back while carried by a person.

In accordance with another embodiment, a blanket assembly for swaddling an infant is provided. The blanket assembly comprises a blanket body defining a pocket between an upper layer and a lower layer of the body at one end of the blanket body, the pocket accessible via an opening selectively closeable to seal the pocket. The blanket assembly also comprises a monolithic neck, spine and spinal cord support device of a semi-rigid material and comprising a generally planar distal portion and a concave section at a proximal portion thereof, the support device removably insertable in the pocket of the blanket body and secured within the blanket by the pocket so as to maintain the support device in a substantially fixed position within the blanket body. The support device is configured to support the head, neck, spine and spinal cord of an infant when the infant is laid on the blanket body in a supine position and wrapped in the blanket body, the infant's head being supported by the concave portion and the infant's torso being supported by the distal portion, so as to inhibit injury to the infant's head and back while carried by a person.

In accordance with another embodiment, a neck, spine and spinal cord support device for supporting an infant is provided. The support device comprises a monolithic body of a semi-rigid material, comprising a generally planar distal portion and a proximal portion having a concave section. The body is configured to support a head, neck, spine and spinal cord of an infant when the infant is laid in supine position on the body, the concave section configured to at least partially receive the infant's head, the distal portion configured to support the infant's back.

In accordance with one another embodiment, an assembly for supporting a baby or infant is provided. The assembly comprises a fabric body defining a pocket between an upper layer and a lower layer of the body at one end of the body, the pocket accessible via an opening. The assembly further comprises a monolithic neck, spine and spinal cord support device of a semi-rigid material, the support device removably insertable in the pocket, wherein the support device comprises a generally planar distal portion and a concave section at a proximal portion thereof, the concave section configured to support the baby's or infant's head and the distal portion configured to support the baby's or infant's torso, a width of the distal portion narrowing between the concave section and a distal end of the support device. The support device is configured to support the head, neck, spine and spinal cord of the baby or infant when placed on the fabric body to inhibit injury to the baby's or infant's head, neck, spine and spinal cord.

In accordance with another embodiment, an assembly for supporting a baby or infant is provided. The assembly comprises a blanket body defining a pocket between an upper layer and a lower layer of the body at one end of the blanket body, the pocket accessible via an opening in the blanket body. The assembly further comprises a monolithic neck, spine and spinal cord support device of a semi-rigid material, the support device removably insertable in the pocket, wherein the support device comprises a distal portion and a concave section at a proximal portion thereof, wherein the baby's or infant's head is supported by the concave section and the infant's torso is supported by the distal portion, and wherein a width of the distal portion narrows in a contoured manner between the concave section and a distal end of the support device relative to a width of the concave section and the distal end of the support device. The support device is configured to support the head, neck, spine and spinal cord of the baby or infant when placed on the blanket body to inhibit injury to the baby's or infant's head, neck, spine and spinal cord.

In accordance with another embodiment, a kit for an assembly for supporting a baby or infant is provided. The kit comprises a swaddle blanket defining a pocket between an upper layer and a lower layer at one end of the blanket, the pocket accessible via an opening in the blanket. The kit further comprises a sleeve sized to be removably insertable in the pocket, the sleeve having a pouch therein accessible via an aperture. The kit further comprises a monolithic neck, spine and spinal cord support device configured to fit within the sleeve and within the pocket of the blanket body, the support device made of a semi-rigid material and comprising a distal portion and a concave section at a proximal portion thereof, wherein a width of the distal portion narrows in a contoured manner between the concave section and a distal end of the support device. The support device is selectively insertable into one or both of the pouch and the pocket and configured to support the head, neck, spine and spinal cord of a baby or infant when placed thereon to inhibit injury to the baby's or infant's head, neck, spine and spinal cord.

In accordance with another embodiment, a swaddle blanket assembly for supporting a baby or infant is provided. The blanket assembly comprises a proximal portion of a blanket body defining a pocket between an upper layer and a lower layer, the pocket accessible via an opening. The blanket assembly further comprises a pair of wings on opposite sides of a center portion of the blanket body configured to be folded over each other and across at least a portion of an infant or baby in a swaddle configuration when in use. The blanket assembly further comprises a distal portion defining a pocket between a top layer and a bottom layer, the pocket configured to receive legs of the baby or infant therein. The blanket assembly further comprises a hip positioner device configured to support the baby's or infant's hips while on the proximal portion, the hip positioner device comprising a bottom portion attached to the blanket body and a top portion movable from an unfolded position to a folded position to releasably couple to the bottom portion and about the hips of the baby or infant with one or more fasteners.

BRIEF DESCRIPTION OF THE DRAWINGS

FIG. 16 is a top view of a baby support device and a pouch of the neck, spine and spinal cord support system of FIG. 15.

FIG. 17 is a top view of the baby support device of FIG. 16 used with the pouch of FIG. 16.

DETAILED DESCRIPTION

Figure 1:
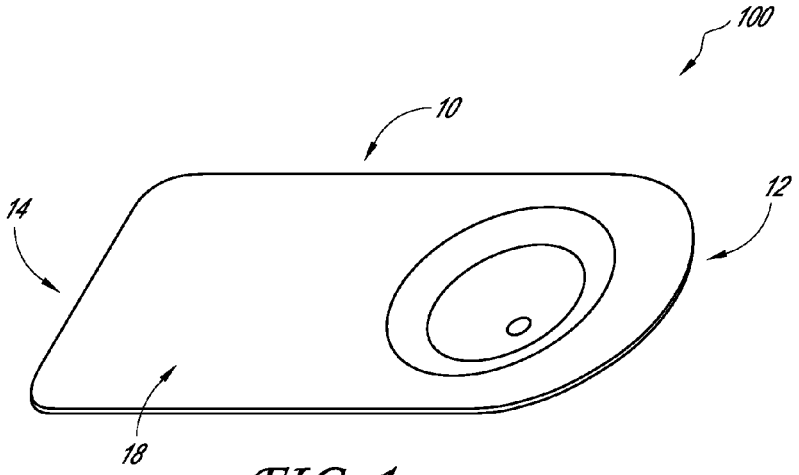
FIG. 1 is a schematic top perspective view of one embodiment of a neck, spine and spinal cord support device for use with a corresponding blanket for supporting a newborn baby or infant.
Figure 2:
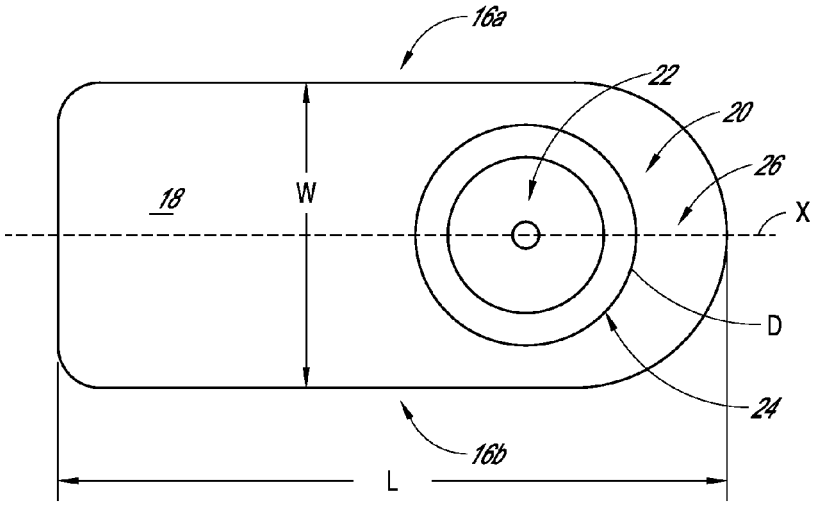
FIG. 2 is a schematic top planar view of the support device of FIG. 1.
Figure 3:
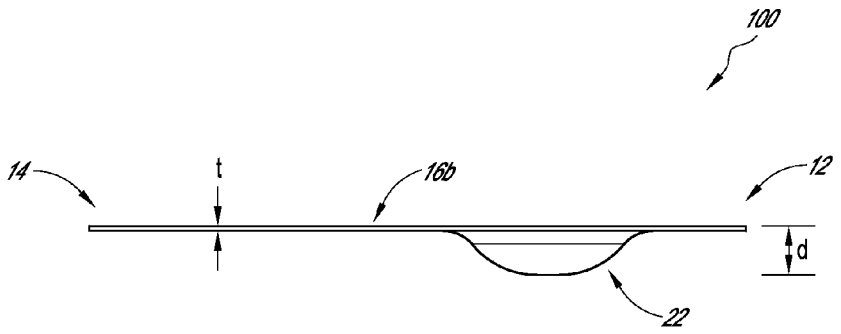
FIG. 3 is a schematic side elevational view of the support device of FIG. 1.
Figure 4:
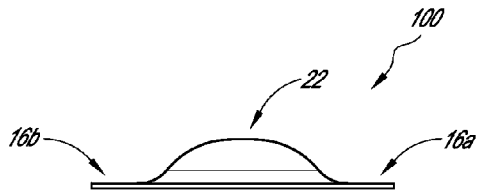
FIG. 4 is a schematic front or rear elevational view of the support device of FIG. 1.
Figure 5A:
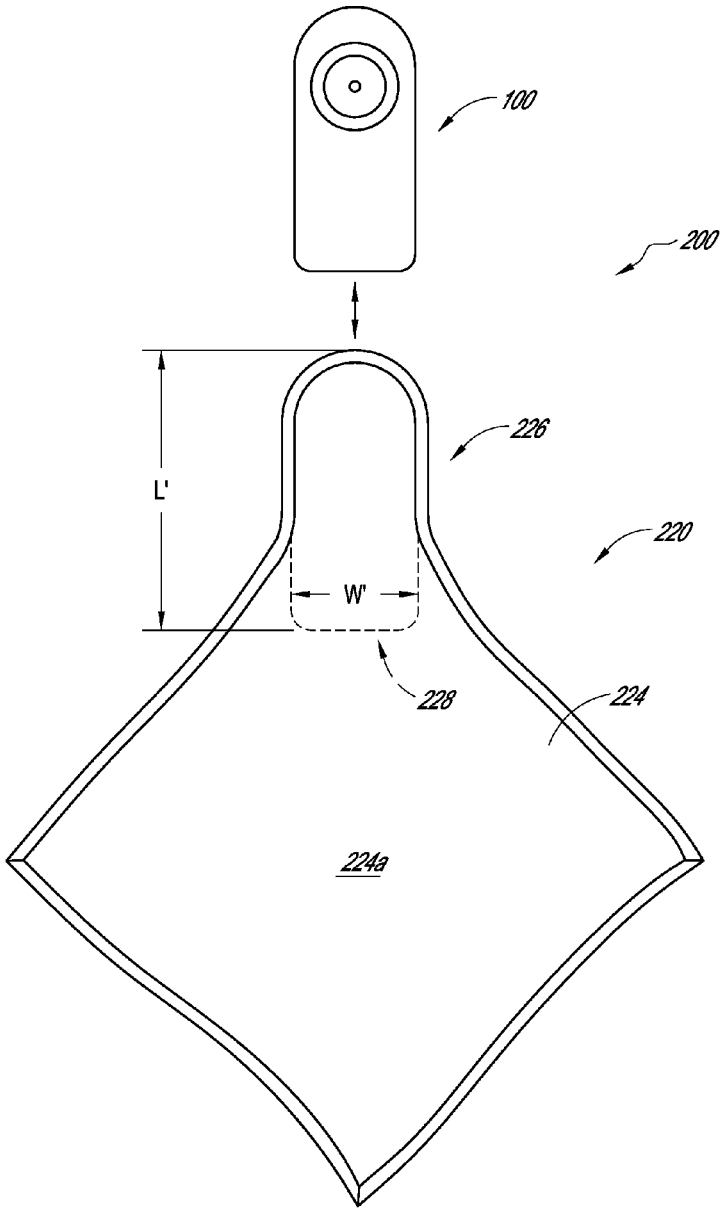
FIG. 5A is a schematic exploded view of one embodiment of a blanket that holds the support device, and the support device of FIG. 1.
Figure 5B:
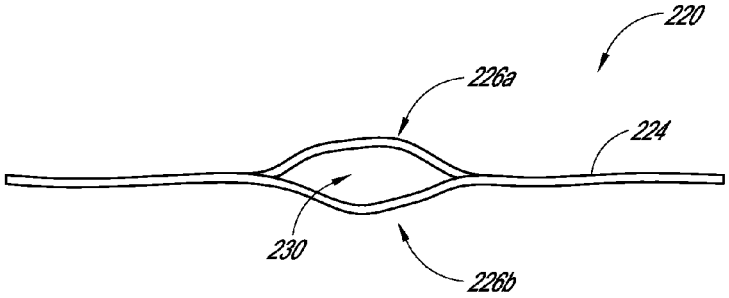
FIG. 5B is a schematic end view of the blanket of FIG. 5A showing an opening that receives the support device therein.
Figure 6:
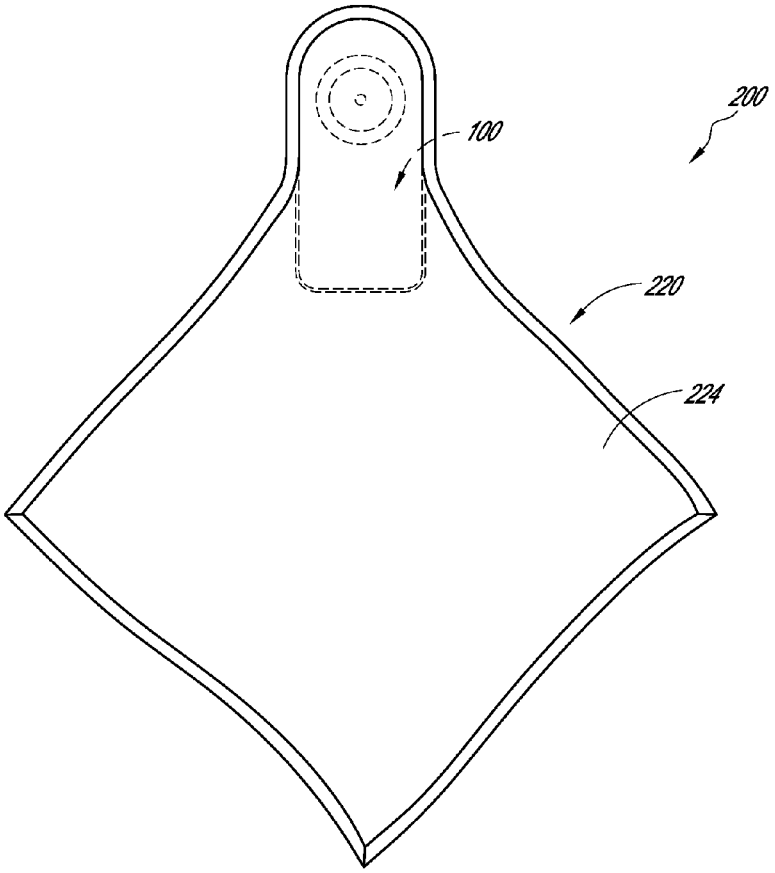
FIG. 6 is a schematic top planar view of the blanket and support device of FIG. 5 in an assembled form.

FIGS. 1-4 show one embodiment of a neck, spine and spinal cord support device 100 that can be used to support the head, neck, spine and spinal cord of an infant, such as a newborn baby. The support device 100 advantageously provides consistent alignment of the head, neck, spine and spinal cord for the baby and can be used until the baby's neck and back muscles sufficiently strengthen (e.g., when the baby is able to support their head without assistance). The support device 100 can have a body 10 that extends from a proximal edge 12 to a distal edge 14 and between a medial edge 16*a* and a lateral edge 16*b*. In the illustrated embodiment, the proximal edge can be curved (e.g., extend along a curve between the medial and lateral edges 16*a*, 16*b*) and the distal edge 14 and be generally straight. However in other embodiments, the proximal edge 12 can be generally straight. In still another embodiment, the distal edge 14 can be curved between the medial and lateral edges 16*a*, 16*b*. In one embodiment, the medial and lateral edges 16*a*, 16*b* can be generally parallel along at least a portion of their length.

In one embodiment, the body 10 can have a distal portion 18 and a proximal portion 20. In one embodiment, the distal portion 18 can be generally planar and have a width W (defined between the medial and lateral edges 16*a*, 16*b*) sized to wider than the torso of an infant (e.g., newborn baby). In one embodiment, the width W can be between about 5 inches and about 9 inches. In another embodiment, the width W can be about 7 inches. The body 10 can have a length L (defined between the proximal and distal edges 12, 14) sized to be longer than the torso of an infant (e.g., newborn baby) such that the infant's buttocks rest on the distal portion 18 proximal of the distal edge 14. In one embodiment, the length L can be between about 12 inches and about 18 inches. In another embodiment, the length L can be about 15 inches. The body 10 can have a thickness t of between about 0.05 inches and about 1 inch. In another embodiment, the thickness t can be about 0.08 inches. In one embodiment, the distal portion 18 can be substantially flat. However, the body 10 can have other lengths L, widths W and thickness t values, higher or lower, than those discussed above.

With continued reference to FIGS. 1-4, the proximal portion 20 can have a concave section 22 with a generally circular outermost perimeter 24. In one embodiment, the perimeter 24 can have a diameter D of between about 4 inches and about 6 inches. In another embodiment, the diameter D can be about 5 inches. The concave section 22 can have a radius of curvature r of between about 1.5 inches and about 2.5 inches. In another embodiment, the radius of curvature r can be about 2 inches. In the illustrated embodiment, the concave section 22 is aligned generally along the axis X of the device 100. Additionally, a boundary portion 26 extends between the outermost perimeter 24 of the concave section 22 and the proximal edge 12 and medial and lateral edges 16*a*, 16*b*. In one embodiment, the boundary portion 26 can be between about 1 inch and about 2 inches in width. In one embodiment, the boundary portion 26 is wider between the proximal edge 12 and the concave section 22 than between the concave section 22 and the medial and lateral edges 16*a*, 16*b*. In another embodiment, the boundary section 26 has the same width between the concave section 22 and the proximal, lateral and medial edges 12, 16*a*, 16*b*. The concave section 22 can be shaped to at least partially receive the head of an infant (e.g., newborn baby) therein so as to comfortably cradle the infant's head therein. For example, the diameter D can be sized so as to be greater than an average distance between the sides of the infant's head so that the perimeter does not tightly fit on the infant's head. Additionally a depth d of the concave section 22 is preferably sized so that between about 5% and about 25% of the infant's head extends into the concave section 22; in another embodiment, the depth d of the concave section 22 can be sized so that less or more of the infant's head extends into the concave section 22 than noted above. In another embodiment, the depth d is preferably sized so that the boundary portion 26 is disposed below the infant's ears when the infant's head rests in the concave section 22. In still another embodiment, the depth d is preferably sized so that when the infant lies on the support device 100, the infant's spine is aligned from the buttocks to the head of the infant. In one embodiment, the depth d can be between about two inches and about three inches. However, the proximal portion 20 can have other suitable dimensions, including other suitable depths.

In one embodiment, the support device 100 can be made of a rigid or semi-rigid material. For example, in one embodiment the device 100 can be made of a plastic material (e.g., a thermoset or thermoplastic material), such as polyurethane, polyester, polystyrene, low-density or high-density polyethylene (PE), polypropylene (PP), and polyvinyl chloride (PVC), and polytetrafluoroethylene. However, other suitable materials can be used, such as hard plastic or resilient materials. In one embodiment, the device 100 can be molded (e.g., injection molded) or manufactured using a cast. However, other suitable methods can be used to manufacture the device 100. The device 100 can preferably support an infant weighing between about 4 lbs. and about 18 lbs., and being between about 16 inches and about 26 inches in length. In the illustrated embodiment, the infant can be supported by the device 100 so that the infant's head rests on the concave section and the infant's back (e.g., including the buttocks) rests on the distal portion 18 so that the infants head and spine are supported when the infant lies (e.g., is in a supine position) on the device 100. The device 100 advantageously provides appropriate support to the infant's head, neck, spine and spinal cord while the infant is held or carried in a person's arm (e.g., carried by a person that is experience, inexperienced or unfamiliar with respect to holding infants correctly).

FIGS. 5A-10 show one embodiment of a baby blanket assembly 200 that includes a blanket 220 (e.g., a swaddle blanket) and can incorporate the support device 100 therein. The blanket 220 can be made of a fabric, such as cotton. However, the blanket 220 can be made of other suitable blanket materials, such as wool, fleece, etc.

Figure 28:
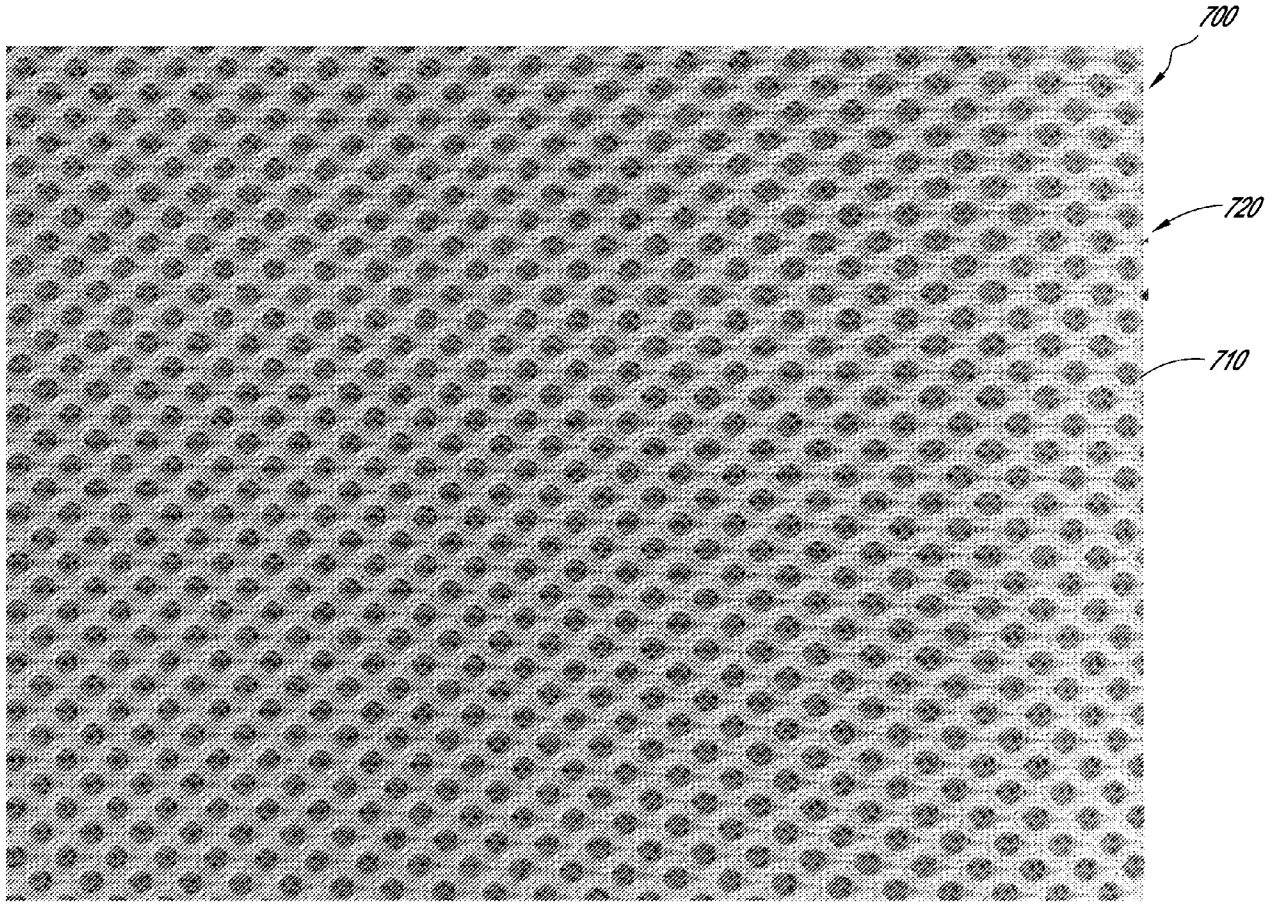
FIG. 28 is a schematic view of a surface of an embodiment of a breathable mesh.
Figure 29:
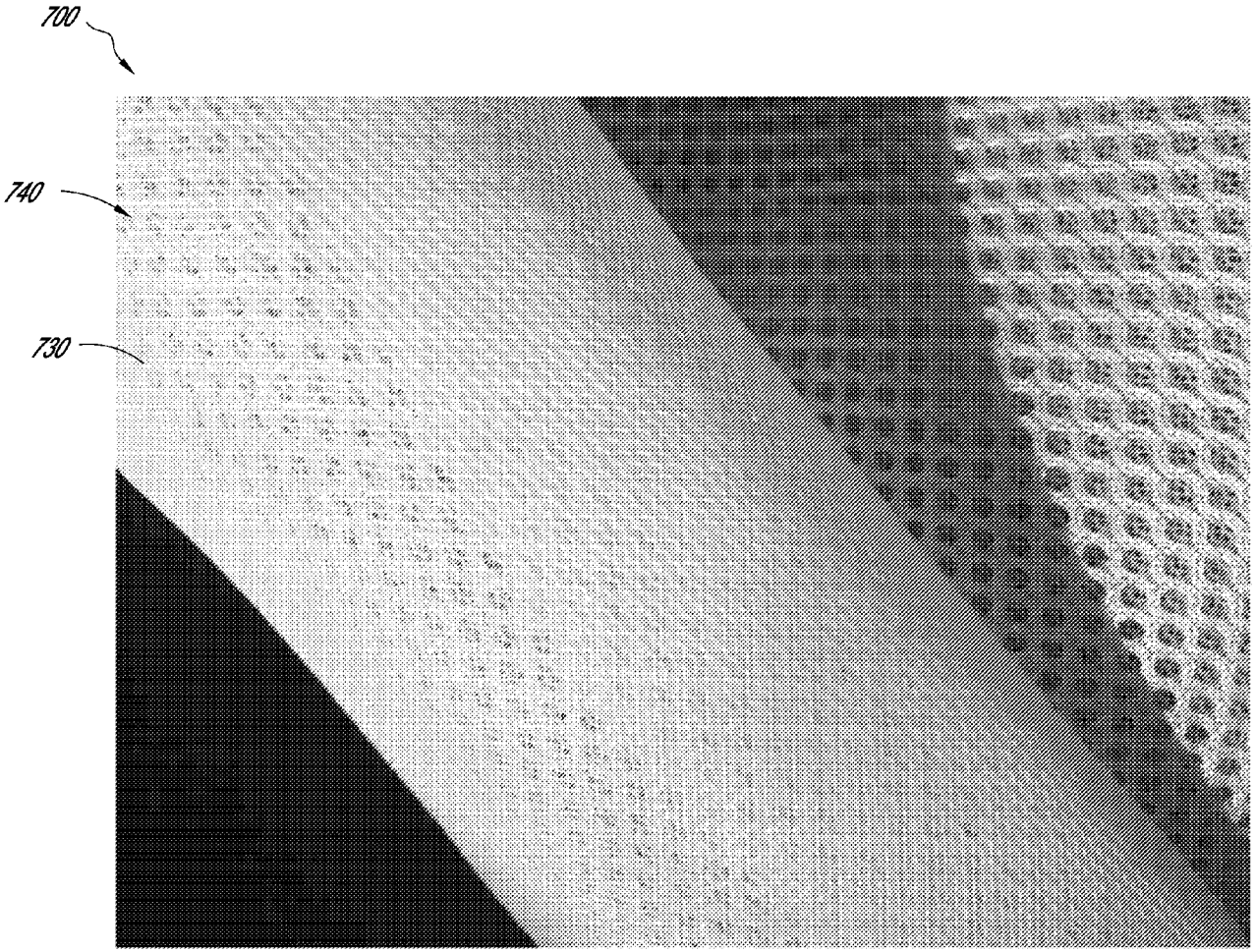
FIG. 29 is a schematic view of another surface of the breathable mesh.

In one embodiment, at least a portion of the blanket 220 can be made of a moisture wicking material or breathable mesh 700 (see FIGS. 28-29) that facilitates maintaining the baby or infant relatively cool while wrapped in the blanket 220 by wicking away sweat from the baby or infant. In one embodiment, only a portion of the blanket 220, such as only the pocket 228 (discussed below) is made of the wicking material 700. As shown in FIGS. 28-29, the wicking material 700 can have one mesh surface 710 with a plurality of openings 720 that allow flow of air therethrough. The opposite side of the wicking material 700, shown in FIG. 29, can have another mesh surface 730 with a plurality of openings 740 that allow flow of air therethrough to provide ventilation of the blanket 220. In one embodiment the size of the openings 720 can be larger than the size of the openings 740. In another embodiment, the openings 720, 740 can have the same size. The wicking material 700 can advantageously be fire retardant, and can advantageously have a high abrasion rating (i.e., high abrasion resistance) that inhibits snag and wear. For example, where the pocket of the blanket body that receives the baby support device is lined or includes the wicking material 700, the material will inhibit snag and wear due to insertion and removal of the baby support device from the pocket during use.

The blanket 220 can have a body 224 with a top surface 224*a* and a bottom surface 224*b*. In the illustrated embodiment, the blanket 220 has a generally square shape when in an unfolded orientation, with a proximal portion 226 having a curved shape that generally corresponds to the curved proximal edge 12 of the support device 100. In other embodiments, the blanket 220 can have other suitable shapes, such as rectangular, circular, triangular and oval. In still other embodiments, the proximal portion 226 can have other suitable shapes that correspond to a shape of the proximal edge of the device 100.

The proximal portion 226 can define a pocket 228 between an upper layer 226*a* and a lower layer 226*b* of the blanket 220 that can be accessed through an opening 230 at the edge of the proximal portion 226. The pocket 228 is preferably sized and shaped to removably receive the support device 100 therein so that the device 100 is enclosed between the layers 226*a*, 226*b* of the blanket 220. In one embodiment, the pocket 228 is sized and shaped so as to securely hold the device 100 in the pocket 228 so that the device 100 does not shift once incorporated into the blanket 220. For example, in one embodiment, the pocket 28 has a length L' and width W' that is generally the same as the length L and width W of the device 100. The opening 230 can be selectively closed with one or more fasteners 232 (see FIG. 7). In one embodiment, the one or more fasteners 232 can be buttons. In another embodiment, the fasteners 232 can be snap fasteners. In still another embodiment, the one or more fasteners 232 can be a zipper. In still another embodiment, the one or more fasteners 232 can be a hoop-and-loop fastener, such as VELCRO®.

Figure 7:
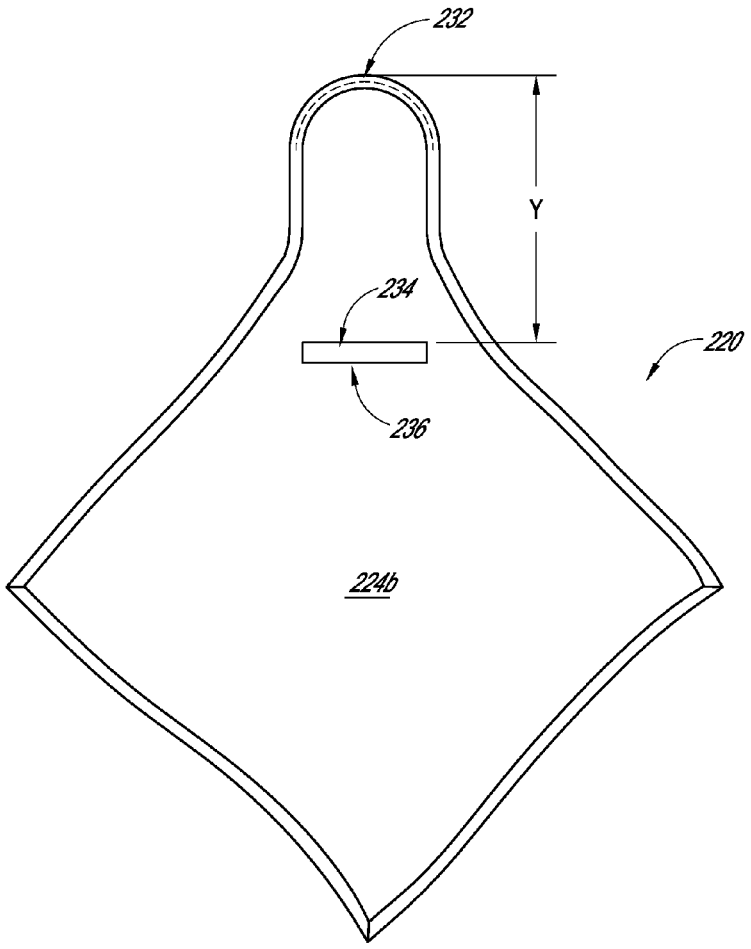
FIG. 7 is a schematic bottom planar view of one embodiment of a blanket for use with the support device of FIG. 1.

With reference to FIG. 7, the blanket 220 can have a strap or hand pocket 234 on the bottom surface 224*b* that defines an opening 236 into which or through which a user can at least partially insert a portion (e.g., fingers, palm) of their hand to provide an additional safety, stability and support for the infant once wrapped with the blanket, as discussed further below. In one embodiment, the strap 234 is located a distance Y from the edge of the proximal portion 226. In one embodiment, the distance Y is between about 7 inches and about 15 inches. In another embodiment the distance Y is about 10 inches. Advantageously, the distance Y can be such that the user's hand would be disposed under the support device 100, such as halfway along the length of the support device 100.

Figure 8:
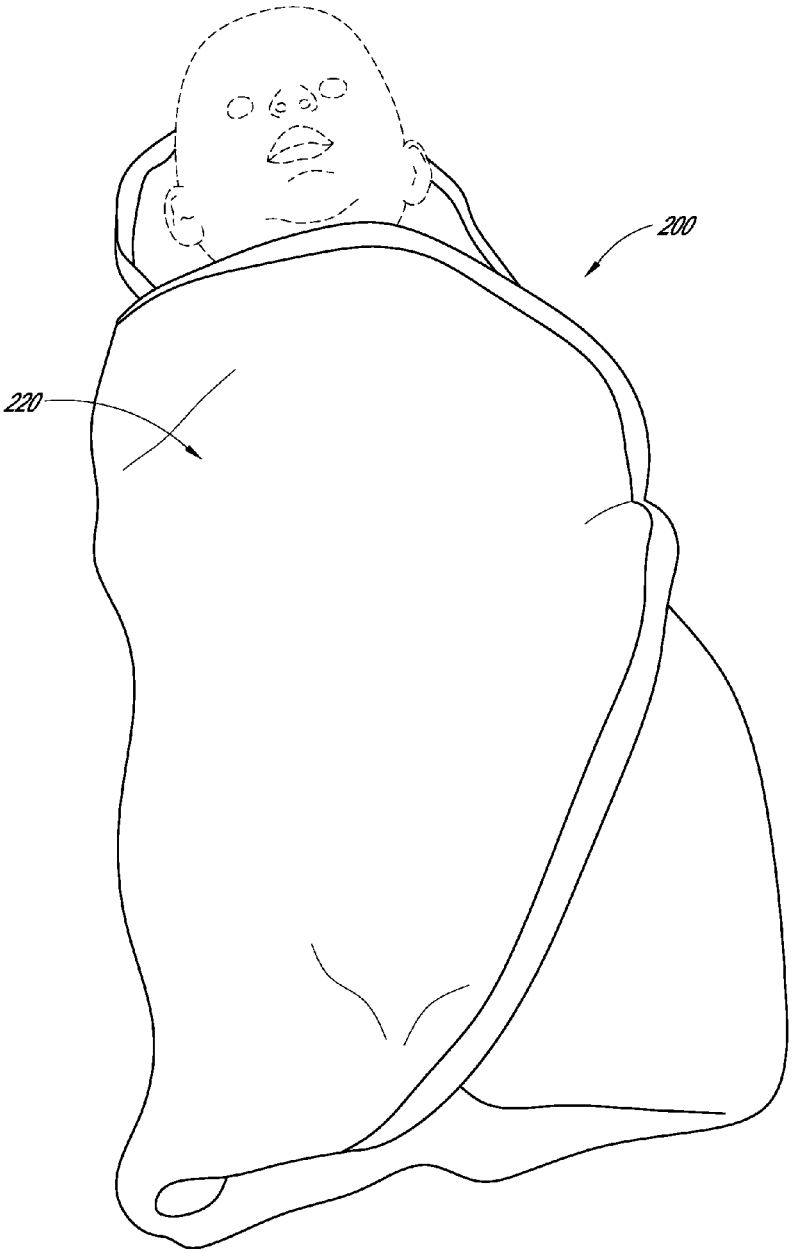
FIG. 8 is a schematic top view of the blanket assembly of FIG. 6 wrapped around a baby.
Figure 9:
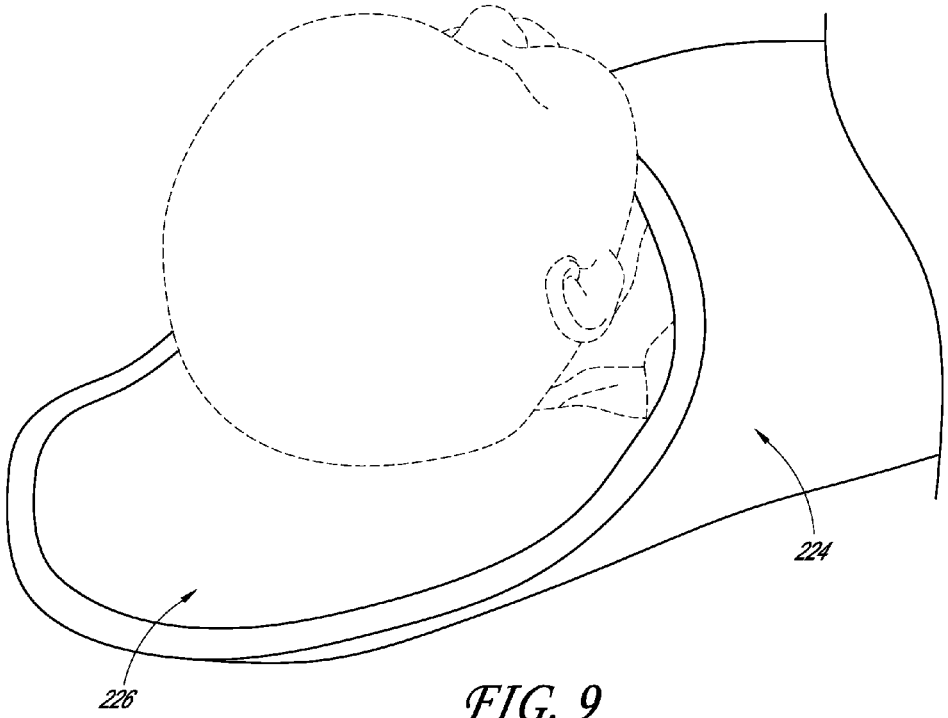
FIG. 9 is a schematic partial side view of the blanket assembly wrapped around the baby of FIG. 8.
Figure 10:
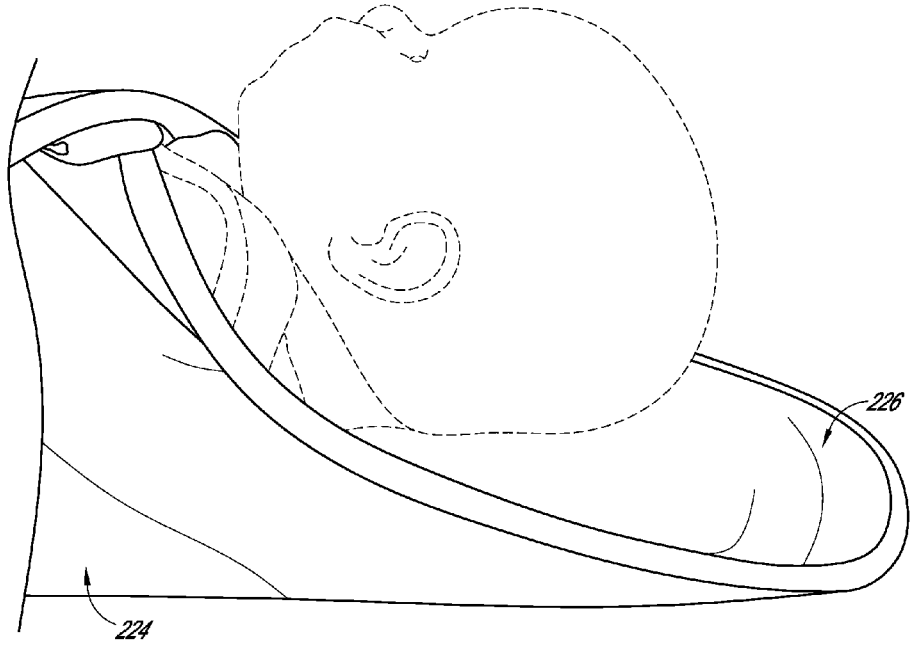
FIG. 10 is a schematic perspective partial view of a user supporting blanket assembly wrapped around a baby, as shown in FIG. 8, with one hand under the support device.

FIGS. 8-10 show the blanket assembly 200 in use. As shown in FIG. 8, the infant (e.g., newborn baby) can be placed on the top surface 224*a* of the blanket 220 so that the infant's head rests on the proximal portion 226 proximate the location of the concave section 22 of the device 100 within the blanket 220, and so that the infant's torso extends toward the center of the blanket 220 and rests over the distal portion 18 of the device 100. The blanket 220 can then be wrapped over the infant (e.g., in a swaddling configuration) so as to generally restrict movement of the infant's arms and legs. Once wrapped, the infant can be held (e.g., even by a person unfamiliar or inexperienced with holding infants, such as newborn babies) in a manner that ensures the infant's head and spine will be properly supported while being carried. As shown in FIG. 9, the blanket 220 and concave section 22 of the support device 100 comfortably support the infant's head without putting pressure on the sides of the infant's head while allowing the curved surface of the concave section 22 to comfortably accommodate the natural curvature of the infant's head. FIG. 10 shows the infant wrapped in the blanket assembly 200 and being held (e.g., supported) with one hand via the strap 234 on the back surface 22*b* of the blanket 220 (e.g., with the user's hand inserted into or through the strap 234 or pocket). Advantageously, the strap 234 allows the person holding the infant with increased flexibility in performing a variety of other tasks with their free hand while securely holding the infant with their other hand.

Figure 11A:
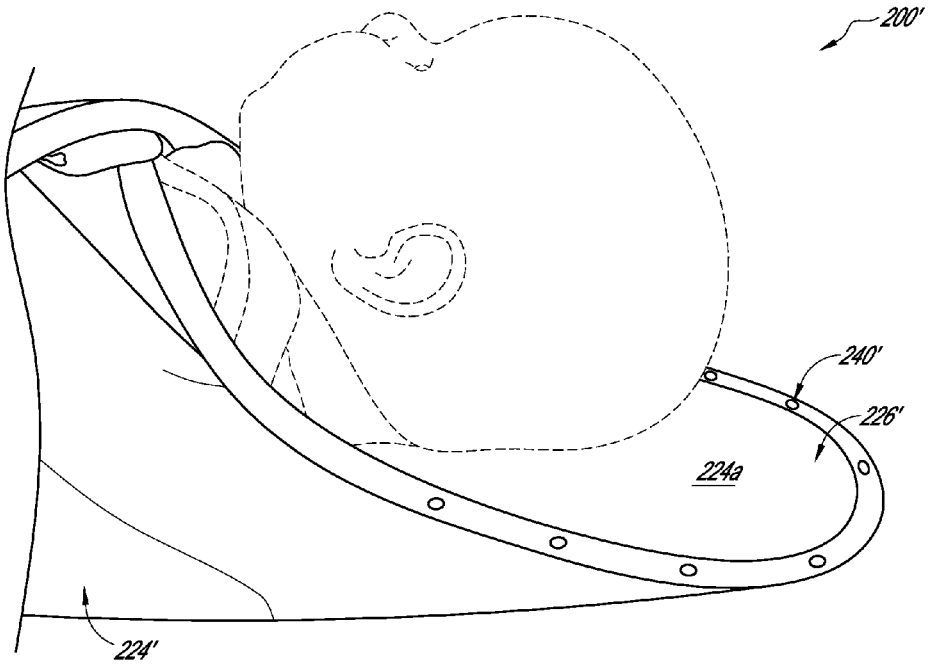
FIG. 11A is a schematic perspective partial view of a portion of one embodiment of the assembled blanket assembly wrapped around the baby of FIG. 8 with fasteners for attaching of a beanie or head cover to the blanket.
Figure 11B:
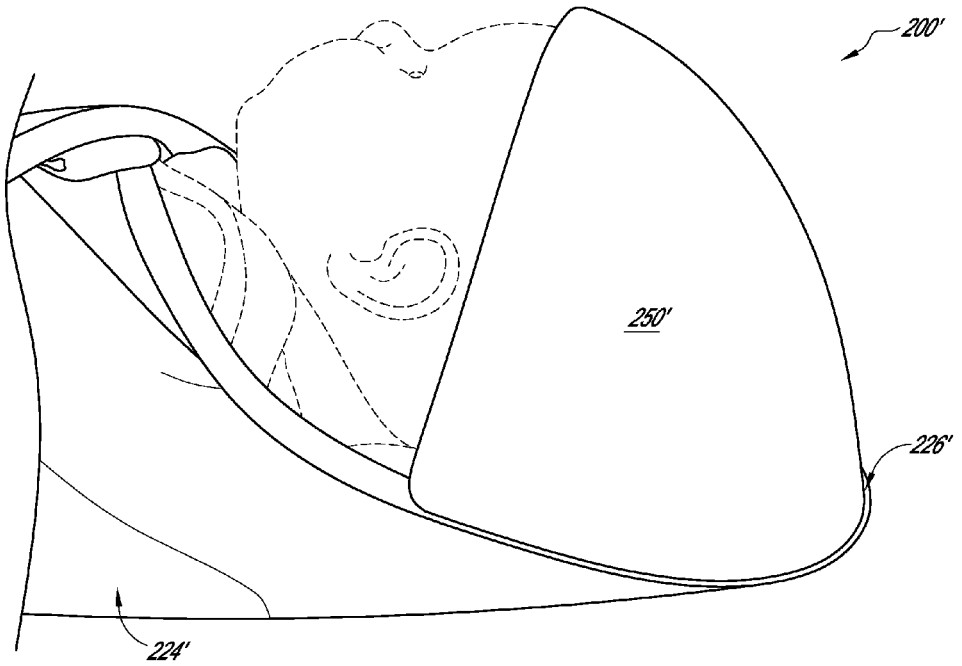
FIG. 11B is a schematic perspective partial view of the assembled blanket assembly of FIG. 11A with the beanie attached to the blanket.

FIGS. 11A-11B show another embodiment of a blanket assembly 200'. The blanket assembly 200' is identical to the blanket assembly 200 shown in FIGS. 5A-10, except as noted below. Thus, the reference numerals used to designate the various components of the blanket assembly 200' are identical to those used for identifying the corresponding components of the blanket assembly 200 in FIGS. 5A-10, except that a "'" has been added to the reference numerals.

The blanket assembly 200' can have one or more fasteners 240' disposed on the top surface 224*a'* of the proximal portion 226' of the blanket body 224'. In the illustrated embodiment, the one or more fasteners 240' are arranged along the perimeter of the proximal portion 226'. In one embodiment, the fasteners 240' can be can be buttons. In another embodiment, the fasteners 240' can be snap fasteners. In still another embodiment, the one or more fasteners 240' can be a zipper. In still another embodiment, the one or more fasteners 240' can be a hoop-and-loop fastener, such as VELCRO®. The one or more fasteners 240' can be used to removably fasten a head cover portion 250' to the proximal portion 226' of the blanket body 224'. The head cover portion 250' can then fit over the forehead of the infant to keep the infant's head warm. Advantageously, the head over portion 250' can inhibit the infant's head from moving forward (e.g., when the infant is held in an elevated position closer to vertical), thereby ensuring the infant's head and neck are properly supported even when the baby is held in a generally upright position. In one embodiment, the head cover portion 250' can be a beanie. In another embodiment, the head cover portion 250' can be shaped like a cap or have a visor portion. In one embodiment the head cover portion 250' can be made of fabric, such as cotton or wool. However, the head cover portion 250' can be made of other suitable materials. In one embodiment, the head cover portion 250' is made of the same material as the blanket 220. In another embodiment, the head cover portion 250' is made of a different material than the blanket 220.

Figure 12:
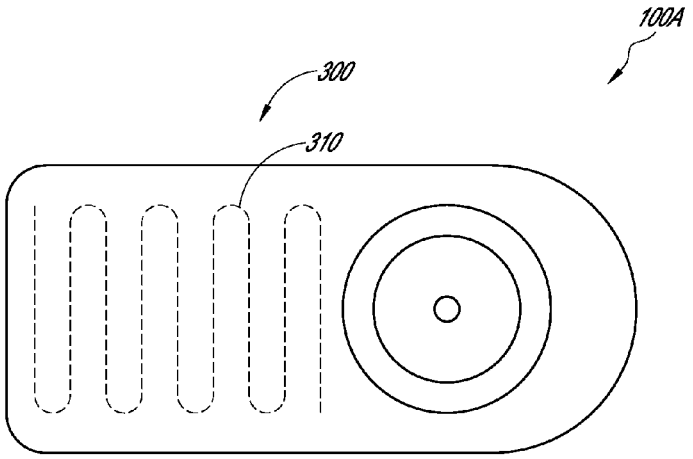
FIG. 12 is a schematic top planar view of another embodiment of a neck, spine and spinal cord support device for supporting a newborn baby or infant.
Figure 12A:
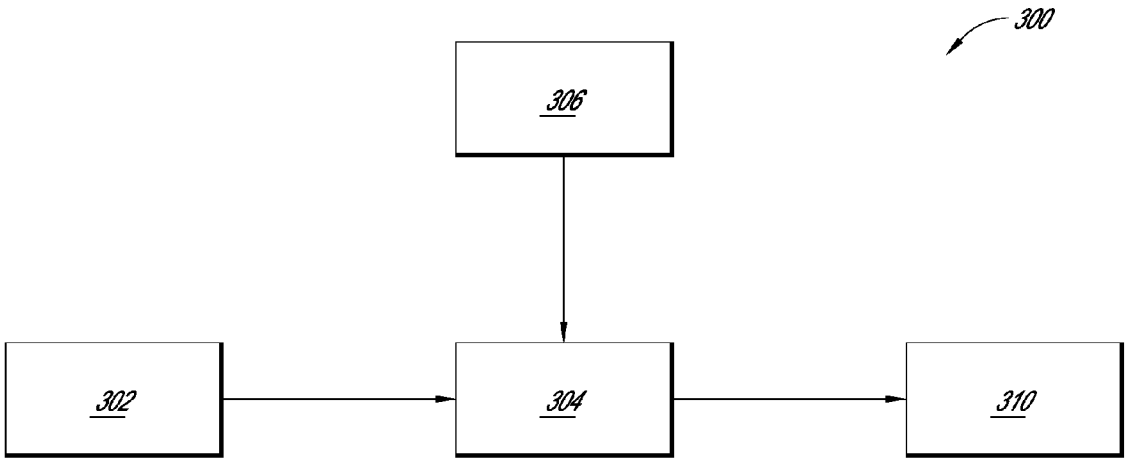
FIG. 12A is a schematic block diagram of one embodiment of a heating system for the support device of FIG. 12.

FIGS. 12-12A show another embodiment of a neck, spine and spinal cord support device 100A for supporting a newborn baby or infant. The support device 100A is similar to the support device 100 shown in FIG. 1, except as noted below. Thus, the reference numerals used to designate the various components of the support device 100A are identical to those used for identifying the corresponding components of the support device 100 in FIG. 1, except as described below.

In the illustrated embodiment, the support device 100A can include (e.g., incorporate) a heating system 300 having one or more heating elements 310 (e.g., resistive heating elements). In one embodiment, the one or more heating elements 310 can be incorporated within the body 10 (e.g., embedded in the body 10). In another embodiment, the one or more heating elements 310 can be provided on an outer surface of the body 10. In still another embodiment, the heating system 300 can be in a separate component (e.g., blanket sleeve) from the body 10, as described further below. In the illustrated embodiment, the one or more heating elements 310 are provided on the distal portion 18 of the body 10. In another embodiment, at least one of the one or more heating elements 310 can be provided in the proximal portion 20 of the body.

In one embodiment, the heating system 300 is at least partially incorporated into the body 10. In another embodiment, one or more components of the heating system 300 can be provided separate from the body 10 (e.g., in a component separate from the body 10).

The heating system 300 can include a switch 302 that can be actuated by a user to turn the heating system 3000N and OFF. In one embodiment, the switch 302 can be provided on a surface (e.g., a bottom surface) of the body 10. The switch 302 can communicate with a controller 304 (e.g., electronic controller) that controls operation of the one or more heating elements 310. The heating system 300 can have one or more batteries 306 (e.g., low voltage batteries), that can provide power to the controller 304 and heating elements 310. In one embodiment, the heating system 310 can include a temperature sensor (e.g. at the one or more heating elements 310 or on a surface of the body 10) that communicates sensed temperature information to the controller 304.

In one embodiment, the controller 304 operates the one or more heating elements 310 a predetermined temperature set point. In another embodiment, the switch 302 can be operated by the user to select one of a plurality of temperature settings (e.g., low, medium, high), and the controller 304 can control the operation of the one or more heating elements 310 (e.g., control the amount of power provided by the one or more batteries 306 to the one or more heating elements 310) based upon the user selected temperature set point provided by the switch 302. In one embodiment, the controller 304 can include (or can be) a temperature limiting switch that can shut power to the one or more heating elements 310 if a temperature limit of the switch is exceeded. The temperature limiting switch can normally be closed during operation of the heating system 300, and can open if the temperature limit for the switch is exceeded. Advantageously, the heating system 300 can be selectively operated by a user to provide additional warmth for the baby and help keep the baby warm and comfortable in cold weather.

Figure 13:
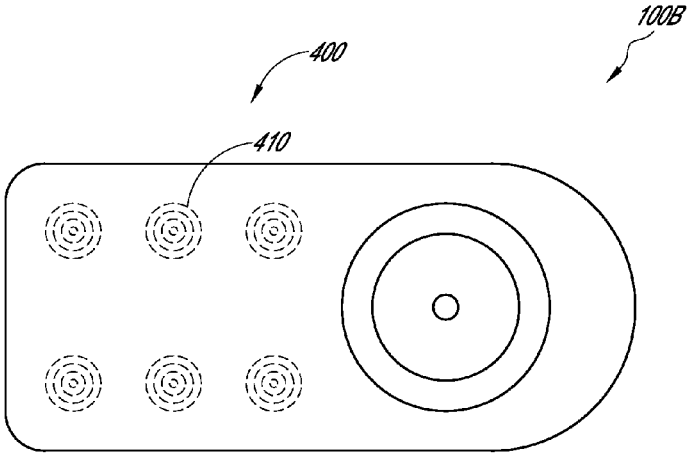
FIG. 13 is a schematic top planar view of another embodiment of a neck, spine and spinal cord support device for supporting a newborn baby or infant.
Figure 13A:
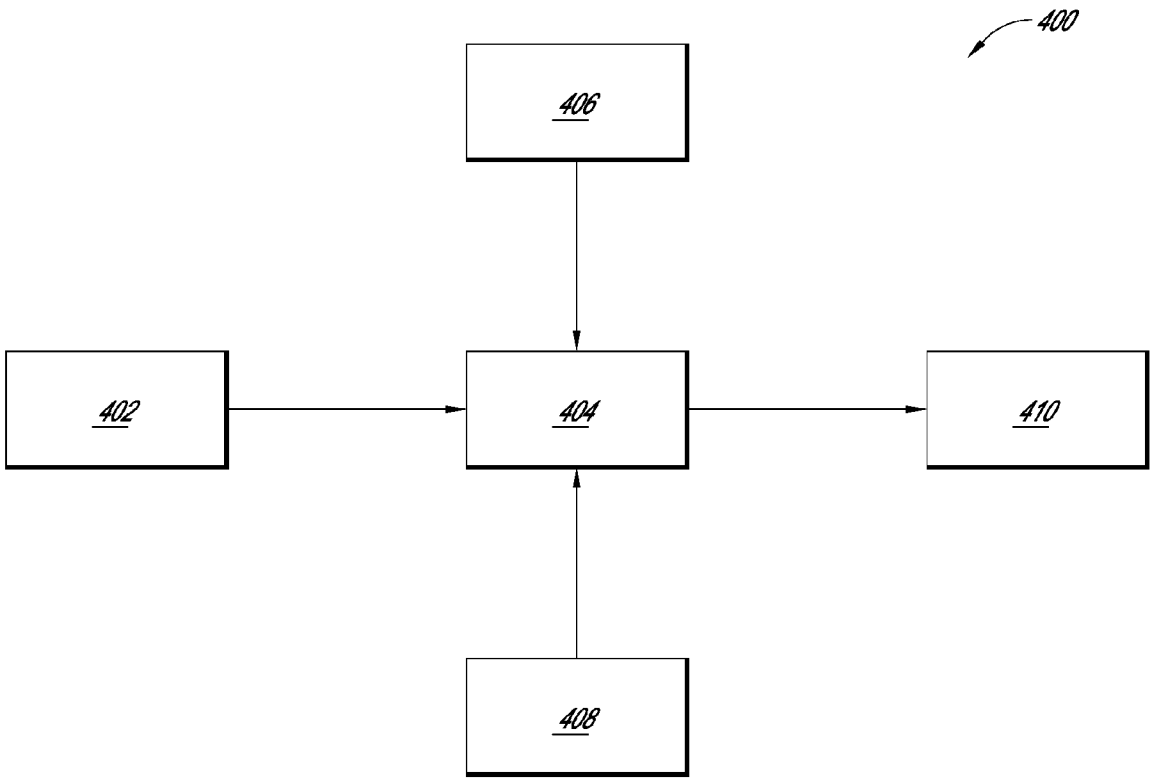
FIG. 13A is a schematic block diagram of one embodiment of a sound or vibration system for the support device of FIG. 13.

FIGS. 13-13A show another embodiment of a neck, spine and spinal cord support device 100B for supporting a newborn baby or infant. The support device 100B is similar to the support device 100 shown in FIG. 1, except as noted below. Thus, the reference numerals used to designate the various components of the support device 100B are identical to those used for identifying the corresponding components of the support device 100 in FIG. 1, except as described below.

In the illustrated embodiment, the support device 100B can include (e.g., incorporate) a sound or vibration system 400 having one or more vibration elements 410 (e.g., speakers, such as piezo speakers). In one embodiment, the one or more vibration elements 410 can be incorporated within the body 10 (e.g., embedded in the body 10). In another embodiment, the one or more vibration elements 410 can be provided on an outer surface of the body 10. In still another embodiment, the sound or vibration system 400 can be in a separate component (e.g., blanket sleeve) from the body 10, as described further below. In the illustrated embodiment, the one or more vibration elements 410 are provided on the distal portion 18 of the body 10. In another embodiment, at least one of the one or more vibration elements 410 can be provided in the proximal portion 20 of the body.

In one embodiment, the sound or vibration system 400 is at least partially incorporated into the body 10. In another embodiment, one or more components of the sound or vibration system 400 can be provided separate from the body 10 (e.g., in a component separate from the body 10).

The sound or vibration system 400 can include a switch 402 that can be actuated by a user to turn the sound or vibration system 4000N and OFF. In one embodiment, the switch 402 can be provided on a surface (e.g., a bottom surface) of the body 10. The switch 402 can communicate with a controller 404 (e.g., electronic controller) that controls operation of the one or more vibration elements 410. The sound or vibration system 400 can have one or more batteries 406 (e.g., low voltage batteries), that can provide power to the controller 404 and vibration elements 410. The sound or vibration system 400 can also include a memory 408 that can store one or more sounds (e.g., heartbeat, breathing sound), and which can communicate such one or more sounds with the one or more vibration elements 410 via the controller 404. In one embodiment, the sound or vibration system 400 can allow the user to record user selected sounds (e.g., Mother's heartbeat, breathing, and/or voice) to the memory 408.

In one embodiment, the controller 404 operates the one or more vibration elements 410 to provide a predetermined sound or vibration. In another embodiment, the switch 402 can be operated by the user to select one of a plurality of sound settings (e.g., heartbeat, breathing, ocean waves), and the controller 404 can control the operation of the one or more vibration elements 310 (e.g., control the amount of power provided by the one or more batteries 406 to the one or more vibration elements 410, or the sound broadcast by the vibration elements 410 via the memory 408) based upon the user selected sound setting provided by the switch 402. In one embodiment, the controller 404 can include a sound limiting switch that can shut power to the one or more vibration elements 410 if the sound level exceeds a predetermined decibel level. The sound limiting switch can normally be closed during operation of the sound or vibration system 400, and can open if the decibel limit for the switch is exceeded. Advantageously, the sound or vibration system 400 can be selectively operated by a user to provide sounds and/or vibrations to comfort and soothe the baby while being supported on the support device 100B.

Figure 14:
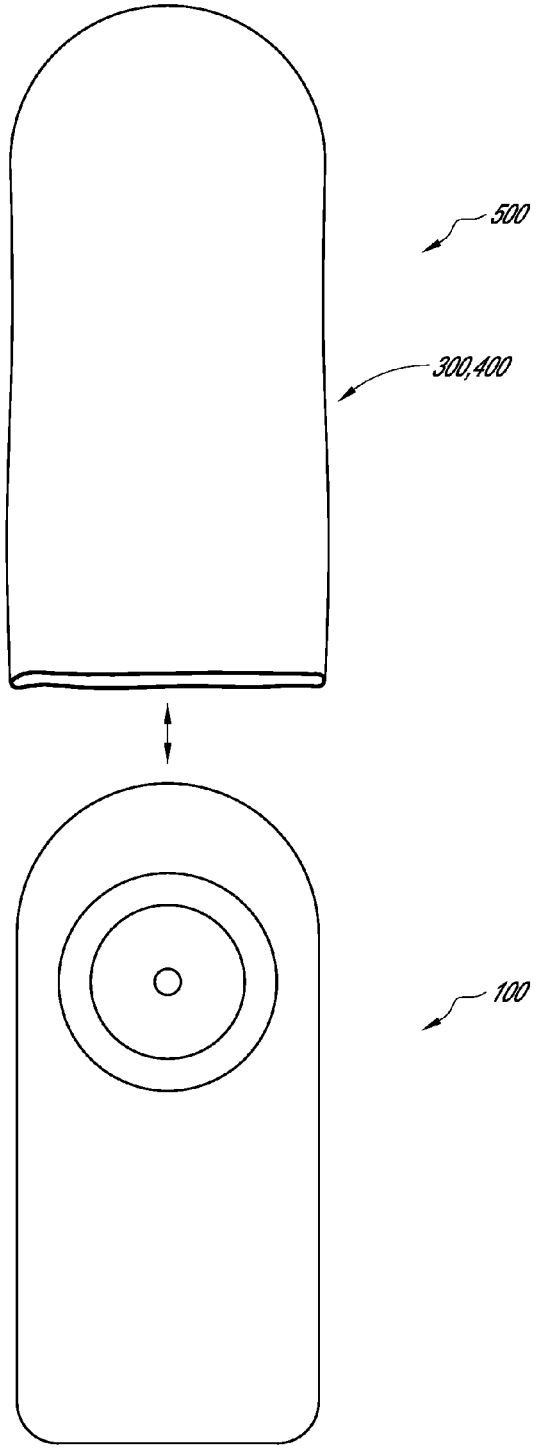
FIG. 14 is a schematic top planar view of one embodiment of a sleeve having a heating and/or sound/vibration system that receives the support device of FIG. 1.
Figure 15:
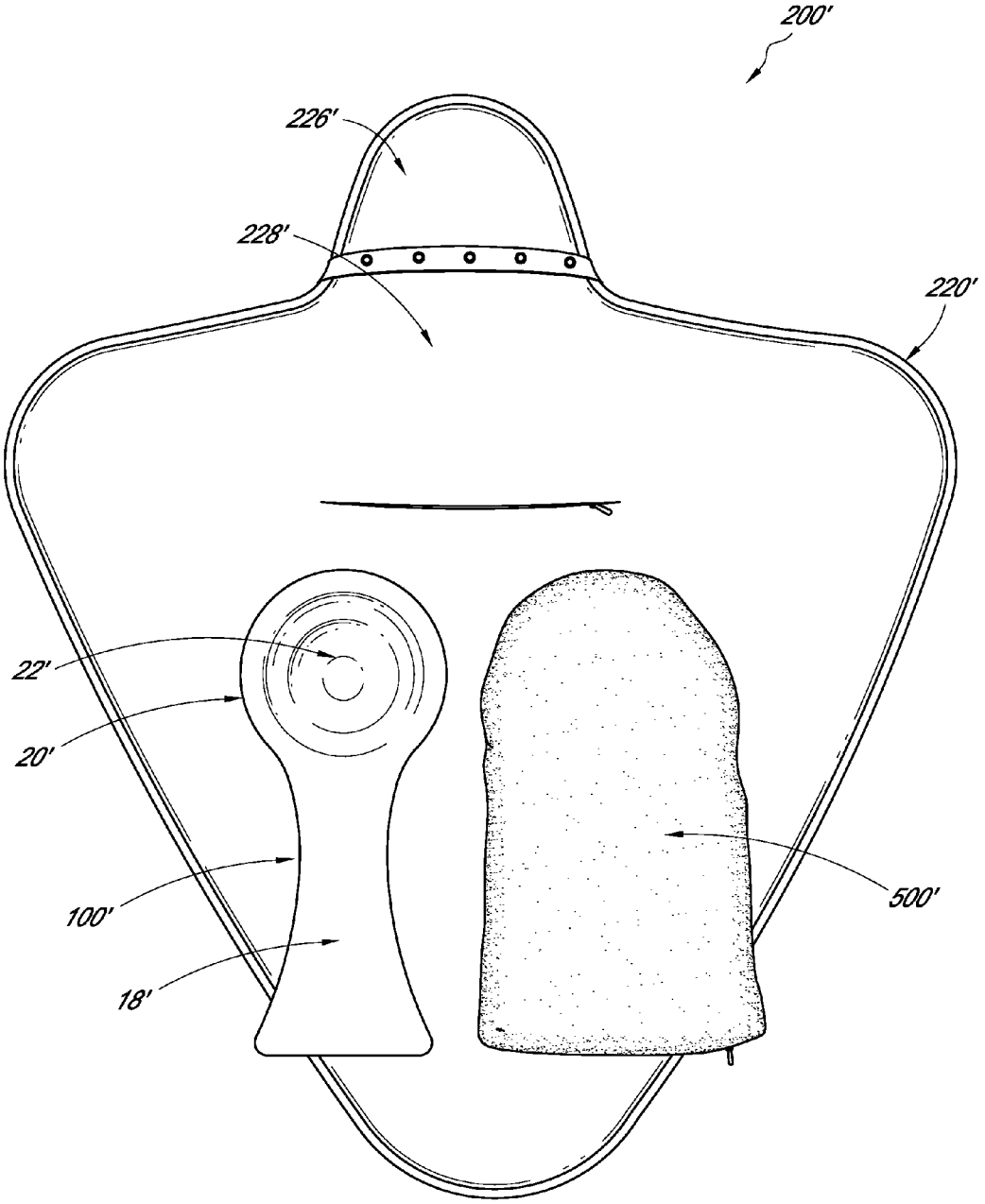
FIG. 15 is another embodiment of a neck, spine and spinal cord support system for supporting a newborn baby or infant.
Figure 19:
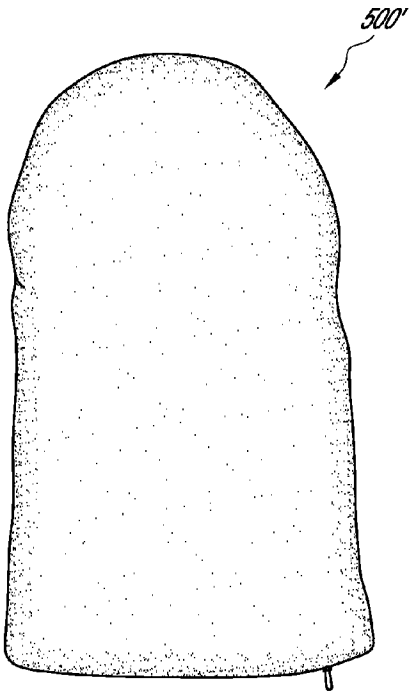
FIG. 19 is a perspective top view of the pouch of FIG. 16.
Figure 18:
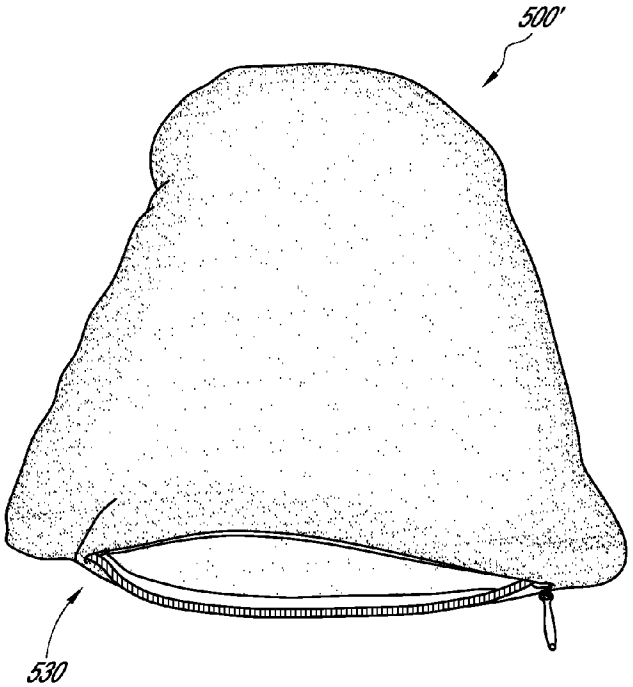
FIG. 18 is an end view of the pouch of FIG. 16.

FIG. 14 shows another embodiment, where the heating system 300 and/or sound/vibration system 400 can be provided in a separate sleeve 500, which can be slipped over the support device 100 to provide a support system that provides heating and/or sound/vibration to the baby while supported on the support device 100. Where the heating system 300 and sound/vibration system 400 are combined, a single switch can operate as the switches 302, 402, a single controller can operate as the controllers 304, 404, and a single battery pack can provide the one or more batteries 306, 406. The sleeve 500 can be made of the same fabric as the blanket 220. In one embodiment, the sleeve 500 can be made of a moisture wicking material to facilitate maintaining at least the head of the infant or baby relatively cool during use of the sleeve 500, such as the wicking material or breathable mesh 700 shown in FIGS. 28-29 and described above.

In one embodiment, the sleeve 500 can be like a heated blanket that can be used to cover the support device 100 so as to provide the heating system 300, as well as cushioning. In one embodiment, once the sleeve 500 is slipped over the support device 100, the combined structure can be inserted into the pocket 228 of the blanket assembly 200. In another embodiment, the blanket assembly 200 can incorporate the heating system 300 or sound/vibration system 400 into the blanket 220.

FIGS. 15-22 show another embodiment of a blanket system 200' (e.g., baby blanket system) that includes a blanket 220' (e.g., a swaddle blanket). The system 200' can optionally incorporate a neck, spine and spinal cord support device 100' (referred to herein as a "support device") that can be used to support the head, neck, spine and spinal cord of an infant, such as a newborn baby. The system 200' optionally includes a pouch or sleeve 500', which is described further below. Similar to the description above for the blanket assembly 200, the blanket 220' can have a pocket 228' in a proximal portion 226' thereof, where the pocket 228' is sized to removably receive one or both of the support device 100' and the sleeve 500'. As shown best in FIG. 17, the sleeve 500' is sized to optionally receive the support device 100' therein. The sleeve 500' can optionally incorporate a heating system or a vibration or sound system, as discussed above in connection with the sleeve 500.

With reference to FIGS. 16-17, the support device 100' has a body that extends from a proximal end 12' to a distal end 14' and has a proximal portion 20' and a distal portion 18'. In the illustrated embodiment, the distal portion 18' has a generally triangular shape and the proximal portion 12' protrudes or extends from said triangular shape. However, the distal portion 18' can have other suitable shapes (e.g., square, rectangular, oval, etc.). The proximal portion 20' has a concave section 22' sized to at least partially support the head of a newborn baby or infant therein. The distal portion 18' can optionally be planar (e.g., flat). In other embodiments, the distal portion 18' can be arched to provide arched support for the newborn baby or infant's spine. A width 19' of the body of the support device 100' can narrow (e.g., decrease in width) between the proximal portion 20' and the distal end 14'. In the illustrated embodiment, the support device 100' is shaped similar to a keyhole in top planar view. In the illustrated embodiment, the width 19' of the body narrows to a width smaller than a width at the distal end 14'. Advantageously, the contoured width (e.g., narrower width 19' of the body) allows the user to hold the newborn baby or infant closer to their body when the support device 100' is incorporated into the blanket body 220', and facilitates holding the baby or infant more comfortably for the user when holding the swaddled baby or infant.

The support device 100' can be removably inserted into the sleeve 500' (e.g., into a pocket or cavity in the sleeve 500') through an opening 530. The opening 530 can be closed with a zipper or other fasteners to close the cavity or pocket of the sleeve 500' (e.g., with the support device 100' therein). The sleeve 500' can have a padded body 520 (e.g., made of any fabric, such as cotton, wool, polyester, etc.). The sleeve 500' can also have a contoured proximal end 510 that can optionally correspond to one or both of the shape of the proximal end 12' of the support device 100' and the shape of the proximal portion 226' of the blanket body 220'. The sleeve 500' and blanket 220' can be made of the same material or can be made of different materials. In some embodiments, at least a portion of the blanket 220' (such as the pocket 228') and/or the sleeve 500' can be made of a moisture wicking material to facilitate maintaining at least the head of the infant or baby relatively cool during use of the sleeve 500, such as the wicking material or breathable mesh 700 shown in FIGS. 28-29 and described above.

Figure 21:
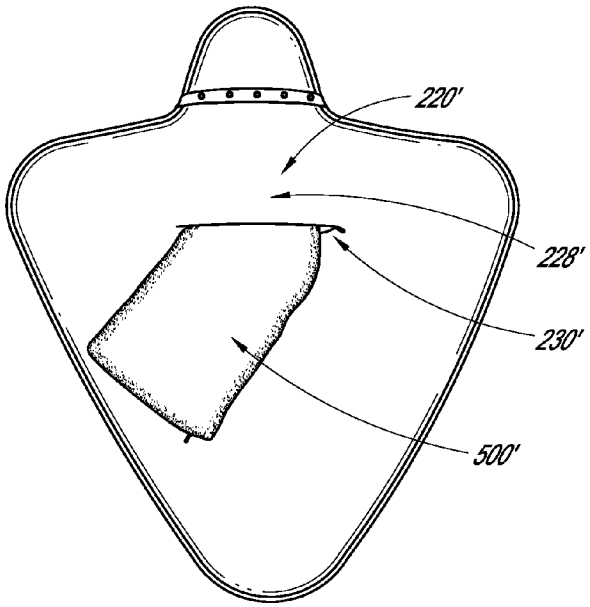
FIG. 21 is a top view of the pouch of FIG. 16 partially inserted through an opening into a pouch of the blanket body of FIG. 15.
Figure 20:
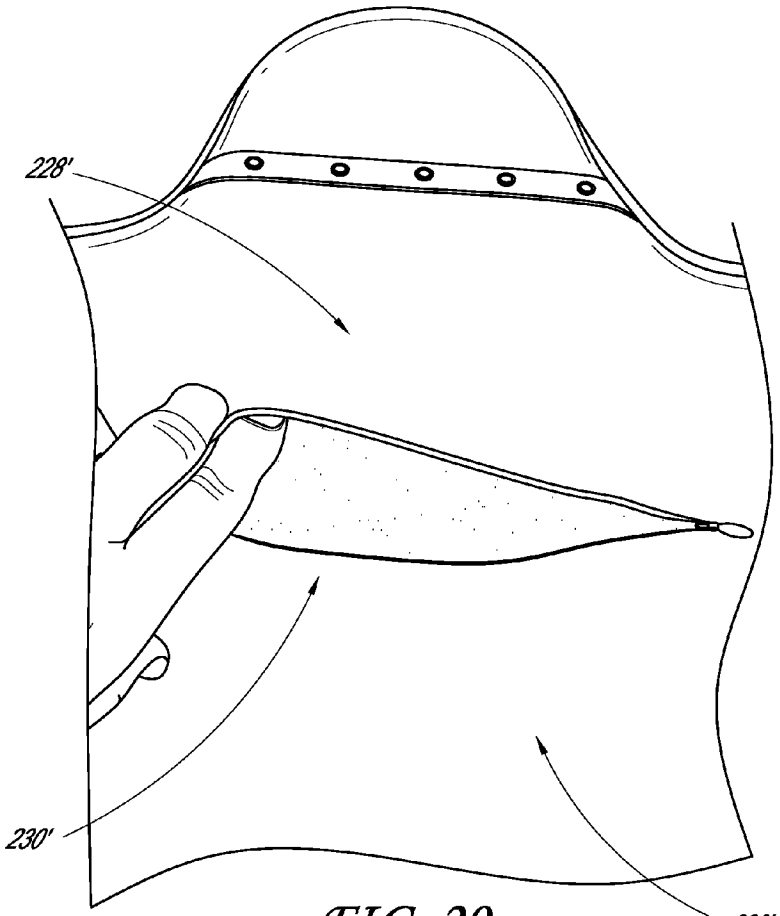
FIG. 20 is a partial top perspective view of a blanket body of the neck, spine and spinal cord support system of FIG. 15, showing an opening of a pocket in the blanket body.
Figure 22:
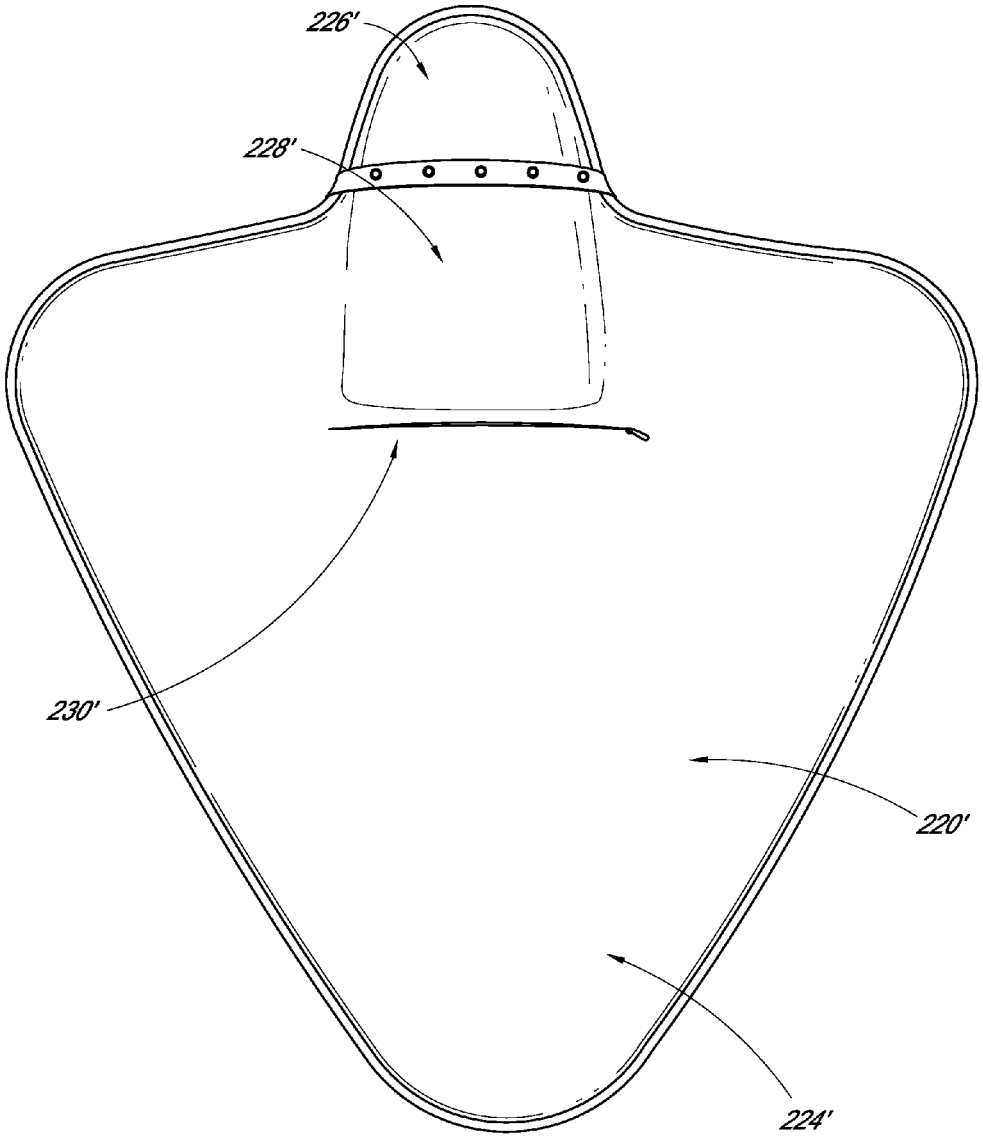
FIG. 22 is a top view of the blanket body of FIG. 15

With reference to FIGS. 20-21, the blanket body 220' can have an opening 230' that allows access to the pocket 228' in the proximal portion 226' of the blanket body 220'. The opening 230' can optionally be closed (e.g., with one or more fasteners, such as hoop-and-loop fasteners, one or more buttons, one or more snaps, a zipper, etc.). The pocket 228' is sized to receive one or both of the support device 100' and the sleeve 500'. FIG. 22 shows the blanket body 220' with the sleeve 500' fully inserted into the pocket 228'. In one variation, the sleeve 500' but not the support device 100' is inserted in the pocket 228' to provide additional padding to the proximal portion 226' of the blanket body 220'. In another embodiment, the support device 100' but not the sleeve 500' is inserted in the pocket 228' and the support device 100' supports the head, neck, spine and spinal cord of an infant, such as a newborn baby, in the manner discussed above for the support device 100. In still another embodiment, the support device 100' is inserted into the sleeve 500' and the sleeve 500' (with the support device 100') is inserted into the pocket 228' of the blanket body 220'. In other embodiments, the pocket 228' can be accessed through an opening at the proximal end of the proximal portion 226' of the blanket body 220'.

Figure 24:
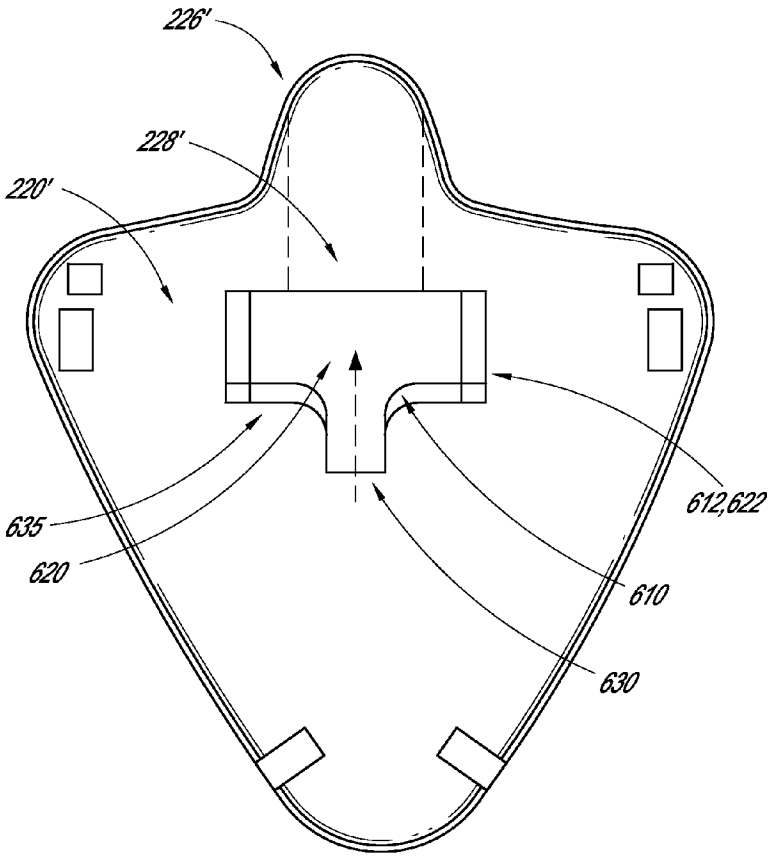
FIG. 24 is a schematic top view of the blanket body of FIG. 23 with the hip positioner device in a closed position.
Figure 23:
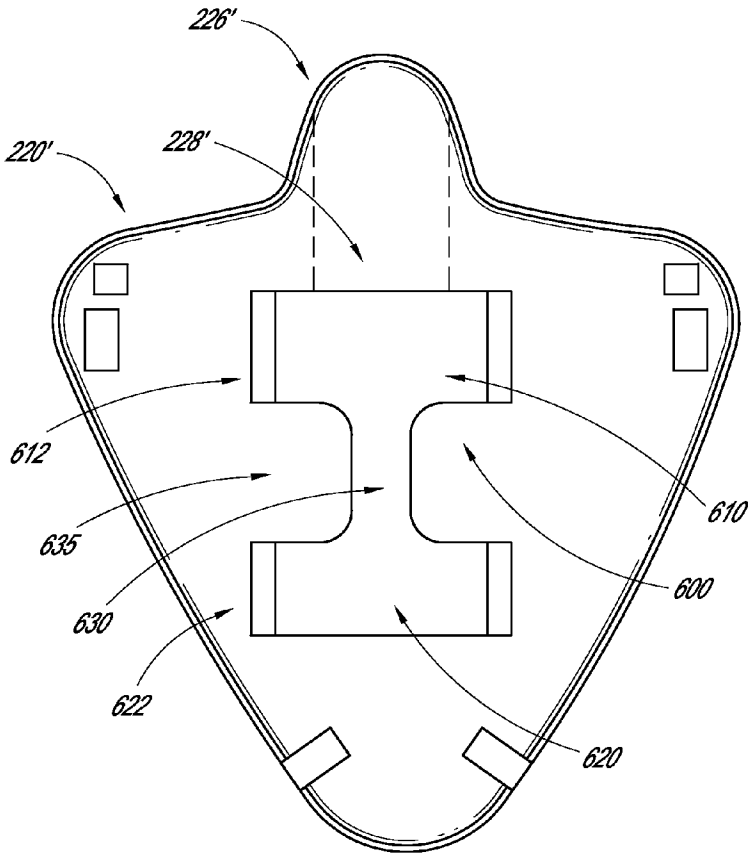
FIG. 23 is a schematic top view of another embodiment of a blanket body of a neck, spine and spinal cord support system with a hip positioner device in an open position.

FIGS. 23-24 show another embodiment of a blanket body 220". The blanket body 220" is similar to the blanket body 220, 220' discusses above, except as noted below. The blanket body 220" has a proximal portion 226" with a pocket 228" therein (see dotted lines).

The blanket body 220" includes a hip positioner device 600 to aid in maintaining the newborn baby's or infant's hips in place when placed on the proximal portion 226" of the blanket body 220" (e.g., when placed over one or both of the support device 100, 100' and the sleeve 500, 500' that are inserted in the pocket 228"). The hip positioner device 600 has a bottom portion 610 and a top portion 620 that is connected to the bottom portion 610 via a crotch portion 630 that defines openings 635 through which the baby's or infant's legs can pass when secured in the hip positioner 600. The bottom portion 610 can be coupled (e.g., sewn) to the blanket body 220". The bottom portion 610 can have one or more fasteners 612 that couple with corresponding one or more fasteners 622 in the top portion 620. Said fasteners 612, 622 can be hoop-and-loop fasteners, one or more buttons, one or more snaps, a zipper, etc. The top portion 620 can be moved from an open position, shown in FIG. 23 where the top portion 620 is not coupled to the bottom portion 610, to allow the baby or infant to be placed on the blanket body 220". The top portion 620 can then be moved from the open position to the closed position, shown in FIG. 24 where the top portion 620 is coupled to the bottom portion 610 via the fasteners 612, 622. In said closed position, the top portion 620 and bottom portion 610 define a brief or diaper, to secure the hips of the baby or infant on the blanket body 220" such that the baby's or infant's torso is generally aligned over the pocket 228" of the blanket body 220". In this manner, the hip positioner 600 advantageously maintains the baby's or infant's torso on the proximal portion 226" of the blanket body 220", and therefore over one or both of the support device 100, 100' and sleeve 500, 500' inserted into the pocket 228". The blanket body 220" can have fasteners (e.g., hoop and loop fasteners) along it's periphery to facilitate folding the blanket body 220" in a swaddling arrangement over the baby or infant.

Figure 25:
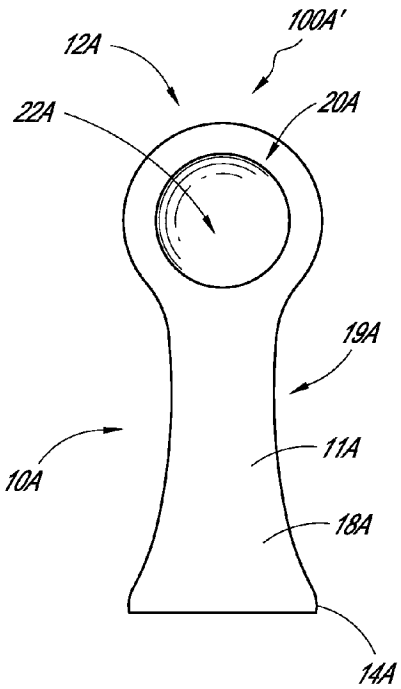
FIG. 25 is a schematic top view of the baby support device.

FIG. 25 illustrates an embodiment of a baby support device 100A' (hereinafter "support device 100A"). The support device 100A' is similar to the support device 100' shown in FIG. 16, except as noted below. Thus, the reference numerals used to designate the various features of the support device 100A' are identical to those used for identifying the corresponding features of the support device 100' in FIG. 16, except that the letter "A'" has replaced the single quotation mark (') in the reference numerals of the support device 100'. Therefore the description for the various features of the support device 100' shown in FIG. 16 are understood to apply to the corresponding features of the support device 100A' in FIG. 25, except as described below.

As shown in FIG. 25, the support device 100A' body also has a plurality of perforations 11A that extend through the thickness of the support device 100A'. The perforations 11A advantageously allow air to flow through the support device 100A' body inhibit the heat-up of the support device 100A' during use. Additionally, the body 10A of the support device 100A' can generally have a keyhole shape (like the support device 100' in FIG. 16), and the distal edge 14A of the body 10A is substantially a straight line.

Figure 26:
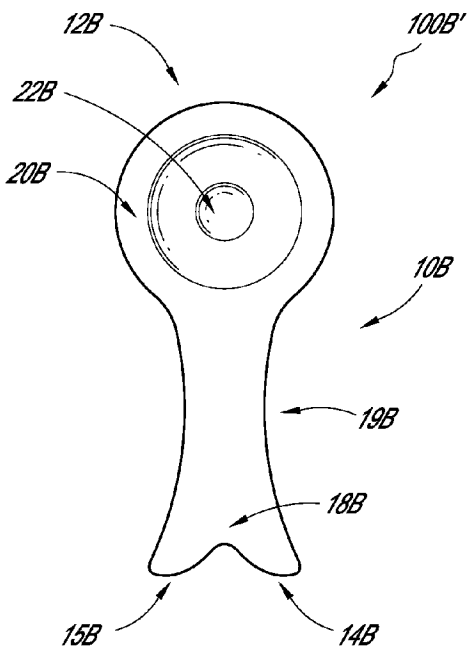
FIG. 26 is a schematic top view of another embodiment of a baby support device

FIG. 26 illustrates an embodiment of a baby support device 100B' (hereinafter "support device 100B"). The support device 100B' is similar to the support device 100' shown in FIG. 16, except as noted below. Thus, the reference numerals used to designate the various features of the support device 100B are identical to those used for identifying the corresponding features of the support device 100' in FIG. 16, except that the letter "B'" has replaced the single quotation mark (') in the reference numerals of the support device 100'. Therefore the description for the various features of the support device 100' shown in FIG. 16 are understood to apply to the corresponding features of the support device 100B' in FIG. 26, except as described below.

As shown in FIG. 26, the support device 100B' body has a flared bottom edge 14B rather than the straight bottom edge 14' of the support device 100'. In one embodiment, the flared bottom edge 14' can more comfortably support the baby's or infant's lower spine. As shown in FIG. 26, the flared bottom edge 14B can define a recess 15B generally at the center or midpoint of the bottom edge 14B, which can more comfortably accommodate the lower spine of the baby or infant that is placed on the support device 100B', either directly or placed onto a blanket, such as the swaddle blankets described herein, that houses the support device 100B'.

Figure 27:
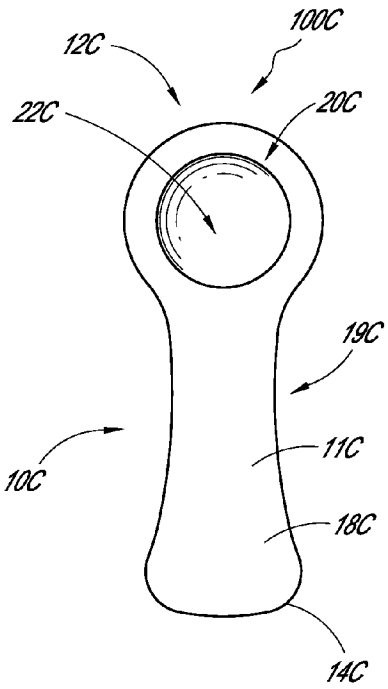
FIG. 27 is a schematic top view of another embodiment of a baby support device

FIG. 27 illustrates an embodiment of a baby support device 100C (hereinafter "support device 100C"). The support device 100C is similar to the support device 100A shown in FIG. 25, except as noted below. Thus, the reference numerals used to designate the various features of the support device 100C are identical to those used for identifying the corresponding features of the support device 100A in FIG. 25, except that the letter "C" has replaced the letter "A" in the reference numerals of the support device 100'. Therefore the description for the various features of the support device 100A shown in FIG. 25 are understood to apply to the corresponding features of the support device 100C in FIG. 27, except as described below.

As shown in FIG. 27, the support device 100C body has a curved bottom edge 14C rather than the straight bottom edge 14A of the support device 100A. In the illustrated embodiment, the curved bottom edge 14C is convex. In another embodiment, the curved bottom edge 14C can be concave. In one embodiment, the curved bottom edge 14C can more comfortably support the baby's or infant's lower spine.

Figures 30A, 30B, 30C:
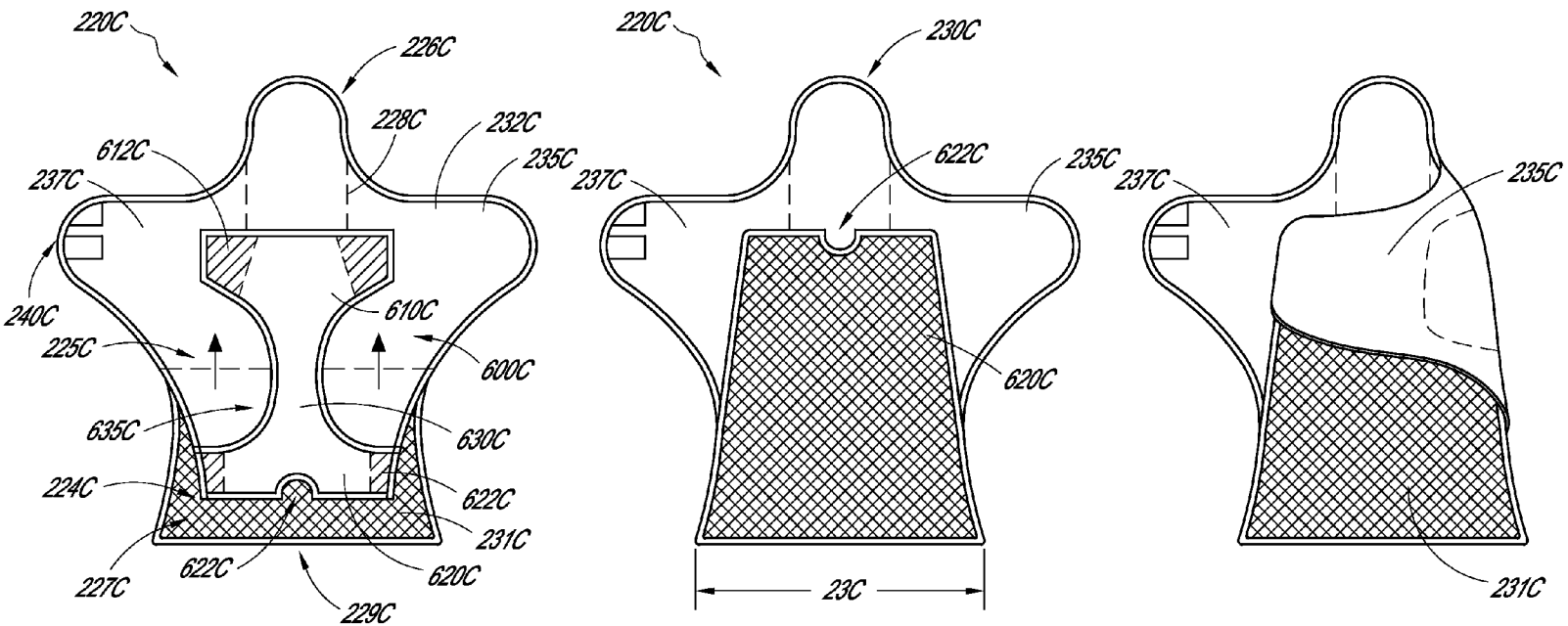
FIGS. 30A-30C show a schematic view of another embodiment of a swaddle blanket.

FIGS. 30A-30C show another embodiment of a blanket 220C. The blanket 220C can be a swaddle blanket and is similar to the blanket body 220" in FIGS. 23-24, except as noted below. Thus, the reference numerals used to designate the various features of the blanket 220C are identical to those used for identifying the corresponding features of the blanket 220" in FIGS. 23-24, except that the letter "C" has replaced the double quotation mark "in the reference numerals of the blanket 220". Therefore the description for the various features of the blanket 220" shown in FIGS. 23-24 are understood to apply to the corresponding features of the blanket 220C in FIGS. 30A-30C, except as described below.

With reference to FIGS. 30A-30C, the blanket 220C has a proximal portion 226C and a distal portion 227C. The blanket 220C has a first wing 235C on one side of the blanket 220C and a second wing 237C on an opposite side of the blanket 220C, where at least one of the wings 235C, 237C has one or more fasteners 240C. As described further below, the wings 235C, 237C can be folded over a center portion of the blanket 220C and can be fastened in the folded position to each other with the one or more fasteners 240C. The one or more fasteners 240C can be hoop-and-loop fasteners, buttons, or other suitable fasteners known in the art.

The distal portion 227C defines a pocket 224C that extends from an opening 225C to a distal edge 229C of the blanket 220C. The pocket 224C can be defined by a separate layer 231C of fabric that is attached to a layer 232C of fabric that defines the base of the blanket 220C. The pocket 224C is sized to receive the baby's or infant's legs when secured to the blanket 220C, as discussed further below.

The blanket 220C includes a hip positioner device 600C to aid in maintaining the newborn baby's or infant's hips in place when placed on the proximal portion 226C of the blanket 220C. The hip positioner device 600C has a bottom portion 610C and a top portion 620C that is connected to the bottom portion 610C via a contoured crotch portion 630C that defines openings 635C through which the baby's or infant's legs can pass when secured in the hip positioner 600C. The bottom portion 610C can be coupled (e.g., sewn) to the blanket 220C (e.g., coupled or sewn to fabric layer 232C). The bottom portion 610C can have one or more fasteners 612C that couple with corresponding one or more fasteners 622C in the top portion 620C. Said fasteners 612C, 622C can be hoop-and-loop fasteners, one or more buttons, one or more snaps, a zipper, etc. The top portion 620C can have a recess or curved edge 622C generally midway along the edge of the top portion 620C. The top portion 620C can be moved from an open position, shown in FIG. 30A where the top portion 620C is not coupled to the bottom portion 610C, to allow the baby or infant to be placed on the blanket 220C so that their head rests on the proximal portion 226C and so their legs extend at least partially within the pocket 224C of the distal portion 227C of the blanket 220C.

The top portion 620C can then be moved from the open position to the closed position, shown in FIG. 30B where the top portion 620C is coupled to the bottom portion 610C via the fasteners 612C, 622C. In said closed position, the top portion 620C and bottom portion 610C define a brief or diaper, to secure the hips of the baby or infant on the blanket 220C such that the baby's or infant's torso is generally aligned over the pocket 228C of the blanket 220C and the baby's or infant's head rests on the proximal portion 226C. In this manner, the hip positioner 600C advantageously maintains the baby's or infant's head and upper torso on the proximal portion 226C of the blanket 220C, and therefore over one or both of the support device 100, 100', 100A, 100B, 100C and sleeve 500, 500' inserted into the pocket 228C. The blanket 220C can have fasteners (e.g., hoop and loop fasteners) along it's periphery to facilitate folding the blanket body 220C in a swaddling arrangement over the baby or infant.

With continued reference to FIGS. 30A-30C, the length between the top portion 620C and the bottom portion 610C of the hip positioner device 600C allows it to comfortably fit over the baby's or infant's hips, and allows for the baby or infant to assume a "frog-leg" position with their legs bent. Additionally, the panel or layer 231C that covers the hip positioner device 600C in the folded position is large enough to allow a user to easily access the baby or infant (e.g., for diaper changes).

With continued reference to FIGS. 30A-30C, the distal portion 227C of the blanket 220C has a distal edge 229C that is generally linear. In other embodiments, the distal edge 229C can be curved (e.g., convex, concave). The width 23C of the distal edge 229C is larger than a width of the proximal portion 226C. In one embodiment, the width 23C of the distal edge 229C can be about 16½ inches. Advantageously, the pocket 224C of the distal portion 227C and the width 23C of the distal edge 229C provides sufficient room for the baby's or infant's legs to thereby allow the baby or infant to assume the "frog-leg" position by bending their legs, and inhibits the baby's or infant's ability to kick-off the swaddle blanket 220C.

As with prior blankets discussed herein, the blanket 220C can removably receive a support device, such as the support device 100, 100A, 100B, 100', 100A', 100B', 100C, in the pocket 228C. The support device can be inserted into the pocket 228C via an opening 230C. In one embodiment, the opening 230C can be at the proximal end of the proximal portion 226C (see FIG. 30B), and the opening can be selectively closed with one or more fasteners (e.g., hoop-and-loop fasteners, snaps, buttons, zipper, etc.). In another embodiment, the opening can be defined at a distal portion of the pocket 228C (e.g., like the opening 230' of blanket 220' in FIG. 20). Additionally, in some embodiments, a sleeve 500, 500' can be inserted in the pocket 228C to provide additional cushioning for the baby's or infant's head and upper torso; the sleeve 500, 500' can optionally include the baby support device therein when positioned in the pocket 228C.

In some embodiments, at least a portion of the blanket 220C (e.g., at least a portion of layers 231C, 232C and hip positioner 600C) can be made of the same material or can be made of different materials. In some embodiments, at least a portion of the blanket 220C (e.g., at least a portion of layers 231C, 232C and hip positioner 600C) can be made of a moisture wicking material to facilitate maintaining at least the head of the infant or baby relatively cool during use, such as the wicking material or breathable mesh 700 shown in FIGS. 28-29 and described above.

With continued reference to FIGS. 30A-30C, the top portion 620C of the hip positioner 600C when folded over the bottom portion 610C can define a generally triangular shape between the proximal portion 226C and the distal portion 227C of the blanket 220C. The wings 235C, 237C can then be folded over a center portion of the blanket 220C to swaddle the baby or infant in the blanket 220C.

Figure 31A:
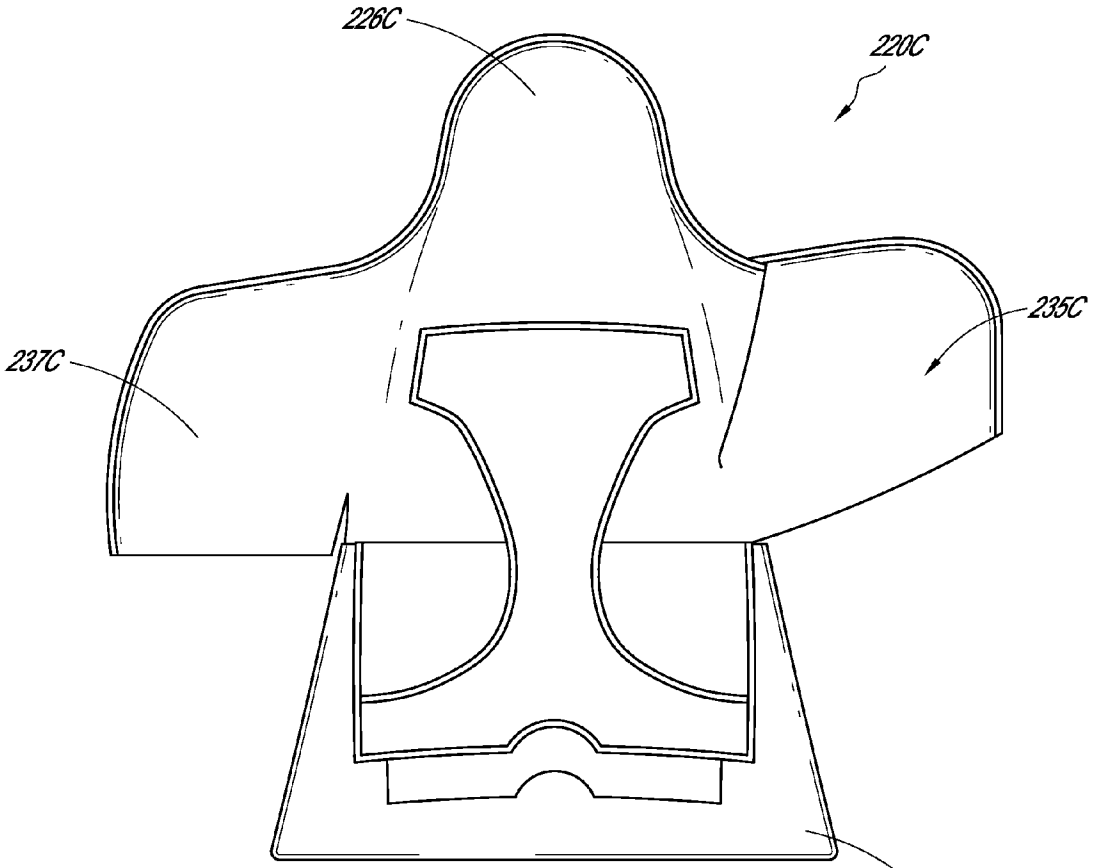
FIG. 31A is a schematic view of the swaddle blanket in the unfolded configuration.
Figure 31B:
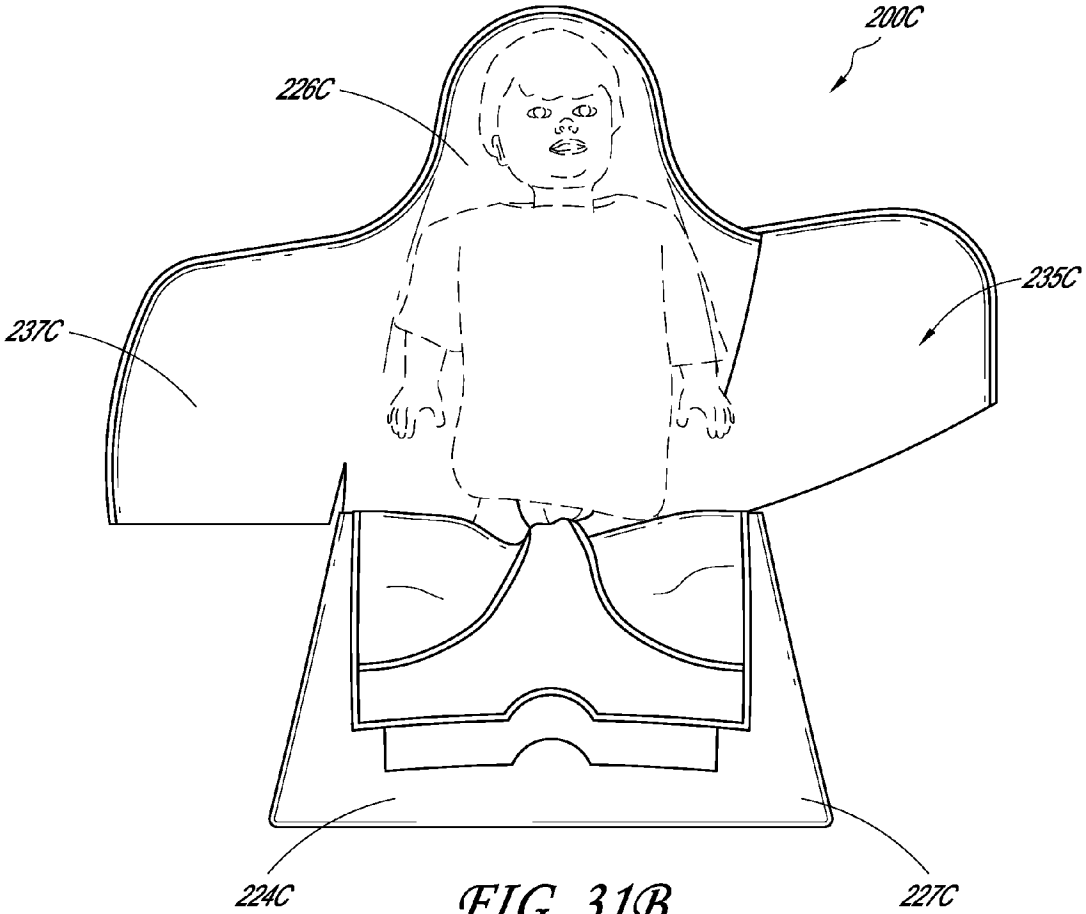
FIG. 31B is a schematic view of a baby placed on the swaddle blanket while in the unfolded configuration.
Figure 32:
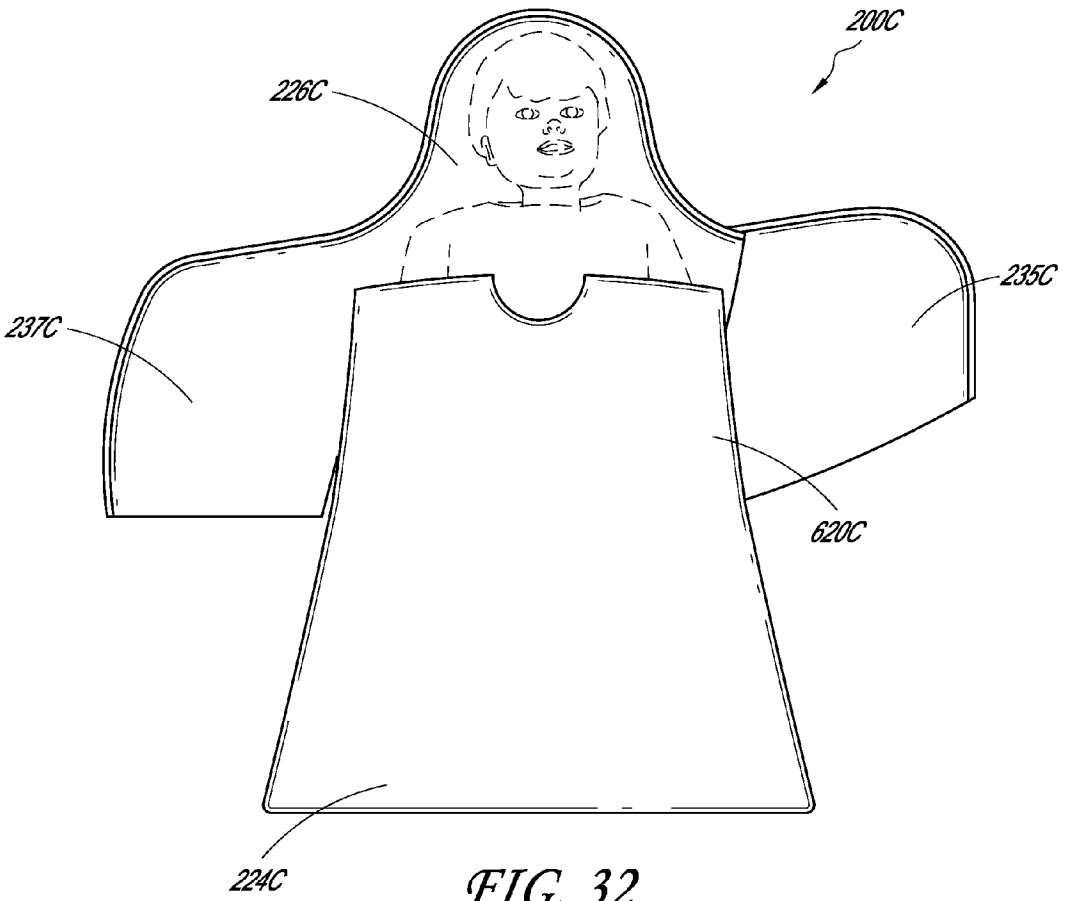
FIG. 32 is a schematic view of the swaddle blanket in FIG. 31B partially folded to secure the baby on the blanket body.
Figure 33:
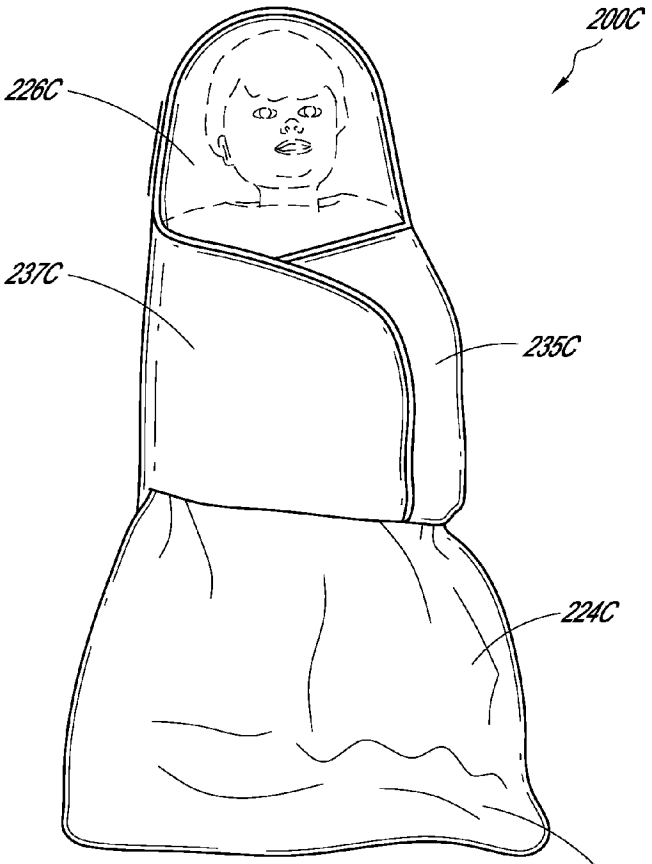
FIG. 33 is a schematic view of the swaddle blanket in FIG. 32 with arms folded to swaddle the baby.

FIGS. 31A-33 illustrate the use of the blanket 220C. FIG. 31A shows the blanket 220C in the unfolded configuration before a baby or infant is placed thereon. FIG. 31B shows a baby or infant initially placed on the blanket 220C so that their legs extend into the pocket 224C of the distal portion 227C and so their head and upper torso rests on the proximal portion 226C of the blanket 220C. FIG. 32 shows the top portion 620C of the hip positioner device 600C folded onto the bottom portion 610C to secure the baby or infant so that their head and upper torso is on the proximal portion 226C of the blanket 220C, and so that the baby's or infant's arms are in the pocket 224C. FIG. 33 shows the wings 235C, 237C folded over a center portion of the blanket and secured over each other with the one or more fasteners 240C to advantageously reduce fussiness of the baby or infant by providing gentle pressure on their stomach area.

In another embodiment, the support device 100, 100' can be incorporated into other devices, other than a blanket, that support a baby or infant while in motion, such as a baby carrier or a car seat. The baby carrier can have arm straps for the user's arms, a waist band to attach a bottom of the carrier to the user's waist, and a back portion against which the baby's head and torso generally rests. The back portion can have a pocket (similar to the pocket 228, 228', 228") for receiving one or both of the support device 100, 100' and sleeve 500, 500'. The functionality and advantages of the support device 100, 100' and/or sleeve 500, 500' discussed above can therefore be incorporated into a baby carrier. Similarly, the car seat can have a pocket (similar to the pocket 228, 228', 228") for receiving one or both of the support device 100, 100' and sleeve 500, 500'. The functionality and advantages of the support device 100, 100' and/or sleeve 500, 500' discussed above can therefore be incorporated into a car seat.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. An assembly for supporting a baby or infant, comprising:

a fabric body defining a pocket between an upper layer and a lower layer of the body at one end of the body, wherein the fabric body is a blanket body used to swaddle the baby or infant, the blanket body having a proximal portion and a free end, the pocket defined in the proximal portion; and a monolithic neck, spine and spinal cord support device of a semi-rigid material, the support device disposed in the pocket, wherein the support device comprises a generally planar distal portion extending to a distal edge of the support device and a contoured section at a proximal portion thereof, the contoured section configured to support the baby's or infant's head and the distal portion configured to support the baby's or infant's torso, the contoured section extending below a bottom surface of the distal portion, an outermost width of the support device narrowing between the contoured section and a distal end of the support device, wherein the support device is configured to support the head, neck, spine and spinal cord of the baby or infant when placed on the fabric body to inhibit injury to the baby's or infant's head, neck, spine and spinal cord.

2. The assembly of claim 1, further comprising a sleeve configured to fit within the pocket, the sleeve comprising a padded surface.

3. The assembly of claim 1, wherein the width of the distal portion narrows in a generally contoured shaped.

4. The assembly of claim 1, further comprising a hip positioner device on the fabric body that supports the baby's or infant's hips while on the fabric body, the hip positioner device comprising a bottom portion attached to the fabric body and a top portion releasably coupleable to the bottom portion and about the hips of the baby or infant with one or more fasteners.

5. The assembly of claim 1, wherein the free end has a generally triangular shape.

6. The assembly of claim 5, wherein the blanket body has a pair of wings configured to fold over each other and across at least a portion of the baby's or infant's torso in a swaddle configuration.

7. The assembly of claim 1, wherein at least a portion of the fabric body comprises a breathable mesh configured to facilitate airflow therethrough to help regulate the temperature of the infant or baby when in use, said breathable mesh configured to wick moisture away from the infant or baby.

8. An assembly for supporting a baby or infant, comprising:

a blanket body defining a pocket between an upper layer and a lower layer of the body at one end of the blanket body, the blanket body configured to swaddle the baby or infant and having a proximal portion and a free end, the pocket defined in a proximal portion of the blanket body; and a monolithic neck, spine and spinal cord support device of a semi-rigid material, the support device disposed in the pocket, wherein the support device comprises a distal portion extending to a distal edge of the support device and a contoured section at a proximal portion thereof, wherein the baby's or infant's head is supported by the contoured section and the infant's torso is supported by the distal portion, the contoured section extending below a bottom surface of the distal portion and wherein an outermost width of the support device narrows in a contoured shape between the contoured section and a distal end of the support device relative to a width of the contoured section and the distal end of the support device, wherein the support device is configured to support the head, neck, spine and spinal cord of the baby or infant when placed on the blanket body to inhibit injury to the baby's or infant's head, neck, spine and spinal cord.

9. The assembly of claim 8, further comprising a sleeve configured to fit within the pocket, the sleeve comprising a padded surface.

10. The assembly of claim 8, wherein the sleeve is configured to receive the support device therein.

11. The assembly of claim 8, wherein the support device is generally shaped like a keyhole.

12. The assembly of claim 8, further comprising a hip positioner device on the fabric body that supports the baby's or infant's hips while on the fabric body, the hip positioner device comprising a bottom portion attached to the blanket body and a top portion releasably coupleable to the bottom portion and about the hips of the baby or infant with one or more fasteners.

13. A kit for an assembly for supporting a baby or infant, comprising:

a swaddle blanket having a blanket body defining a pocket between an upper layer and a lower layer at one end of the blanket;

a sleeve sized to fit in the pocket, the sleeve having a pouch therein accessible via an aperture; and a monolithic neck, spine and spinal cord support device configured to fit within the sleeve and within the pocket of the blanket body, the support device made of a semi-rigid material and comprising a distal portion extending to a distal edge of the support device and a contoured section at a proximal portion thereof, the contoured section extending below a bottom surface of the distal portion, an outermost width of the support device narrowing in a contoured shape between the contoured section and a distal end of the support device, wherein the support device is sized to fit inside one or both of the pouch and the pocket and configured to support the head, neck, spine and spinal cord of a baby or infant when placed thereon to inhibit injury to the baby's or infant's head, neck, spine and spinal cord.

14. The kit of claim 13, further comprising a hip positioner device that supports the baby's or infant's hips while on the blanket body, the hip positioner device comprising a bottom portion attached to the blanket body and a top portion releasably coupleable to the bottom portion and about the hips of the baby or infant with one or more fasteners.

15. The kit of claim 13, wherein at least a portion of one or both of the swaddle blanket and sleeve comprises a breathable mesh configured to facilitate airflow therethrough to help regulate the temperature of the infant or baby when in use, said breathable mesh configured to wick moisture away from the infant or baby.

16. The kit of claim 13, wherein the support device has a perforated surface configured to allow air to pass therethrough to help regulate the temperature of the infant or baby when in use.

17. A swaddle blanket assembly for supporting a baby or infant, comprising:

a first fabric layer defining a base layer of a blanket body from a proximal portion to a distal portion of the blanket body on which the body of the baby or infant is configured to rest;

a second fabric layer disposed above the first fabric layer and having a distal end attached to the distal portion of the first fabric layer, the second fabric layer defining an inner surface and an outer surface and extending toward the proximal portion of the first fabric layer, the inner surface of the second fabric layer disposed opposite the distal portion of the first fabric layer and defining one or more pockets therebetween configured to receive the legs of the baby or infant therein;

a second pocket defined in the proximal portion of the blanket body between the first fabric layer and a third fabric layer disposed below the first fabric layer, the second pocket being accessible through an opening in the blanket body that is selectively closed by the user, the second pocket configured to receive a baby support device configured to support a head and spine of the baby or infant when placed on the blanket body;

a pair of wings on opposite sides of a center portion of the blanket body configured to be folded over each other and across at least a portion of an infant or baby in a swaddle configuration when in use; and a hip positioner device configured to support the baby's or infant's hips while on the blanket body such that the baby's or infant's head is positioned over the second pocket at the proximal portion of the blanket body, the hip positioner device comprising a bottom portion attached to the first fabric layer, a top portion attached to the inner surface of the second fabric layer and movable from an unfolded position to a folded position to releasably couple to the bottom portion and about the hips of the baby or infant with one or more fasteners, and a band portion that extends between the bottom and top portions and configured to extend between the legs of the baby or infant, the band portion having a smaller width than that of the top and bottom portions.

18. The assembly of claim 17, further comprising a sleeve configured to fit within the second pocket of the proximal portion of the blanket body, the sleeve comprising a padded surface.

19. The assembly of claim 18, wherein at least a portion of one or both of the swaddle blanket and sleeve comprises a breathable mesh configured to facilitate airflow therethrough to help regulate the temperature of the infant or baby when in use, said breathable mesh configured to wick moisture away from the infant or baby.

20. The assembly of claim 18, further comprising a monolithic neck, spine and spinal cord support device configured to fit within one or both of the sleeve and within the second pocket of the blanket body, the support device made of a semi-rigid material and comprising a distal portion and a proximal portion, an outermost width of the distal portion narrowing in a contoured shape between the proximal portion and a distal end of the support device.

21. A neck, spine and spinal cord support device for supporting an infant, comprising:

a monolithic body extending between a bottom end and a top end that at least partially defines a boundary of the body, the body having a top surface and a bottom surface, the body having a length so that the body extends from above an infant's head to below the infant's buttocks, thereby allowing the infant's legs and feet to be free to move or be tucked for comfort while the infant is supported on the support device, an opening defined in the top surface of a proximal section of the body, the opening configured to receive a baby's or infant's head therethrough; and a contoured portion attached to the body and extending below the opening of the monolithic body, at least a portion of the contoured portion extending below a bottommost edge of a rest of the monolithic body, the contoured portion configured to support the infant's head, wherein a distal portion of the monolithic body is configured to support the infant's torso and the contoured portion is configured to support the infant's head so that the support device supports the head, neck, spine and spinal cord of the infant in an aligned orientation when the infant is supported on the support device.

22. The support device of claim 21, wherein a width of the distal portion narrows in a contoured shape between the proximal section and a distal end of the support device relative to a width of the proximal section and the distal end of the support device.

23. The support device of claim 21, wherein the contoured portion and monolithic body are one piece.

24. A neck, spine and spinal cord support device for supporting a baby or an infant, comprising:

a monolithic body extending between a bottom end and a top end that at least partially defines a boundary of the body, the body having a top surface and a bottom surface, the body having a length so that the body extends from above a baby's or infant's head to below the baby's or infant's buttocks, thereby allowing the baby's or infant's legs and feet to be free to move or be tucked for comfort while the baby or infant is supported on the support device, the monolithic body having a planar portion that extends from a side edge of the boundary to an opposite side edge of the boundary, the planar portion having a plurality of perforations that extend through the planar portion from the bottom surface to the top surface to allow air to flow through the monolithic body to cool the baby or infant when supported on the monolithic body, wherein a distal portion of the monolithic body is configured to support the baby's or infant's torso and wherein a proximal section is configured to at least partially receive and support the baby's or infant's head so that the monolithic body supports the head, neck, spine and spinal cord of the baby or infant in an aligned orientation when the baby or infant is supported on the monolithic body, the proximal section comprising a contoured portion configured to at least partially receive and support the head of the baby or infant, the contoured section extending below a bottom surface of the planar portion, and wherein a width of the distal portion narrows in a contoured shape between the proximal section and the distal end of the support device.

* * * * *

UNITED STATES PATENT AND TRADEMARK OFFICE

CERTIFICATE OF CORRECTION

PATENT NO. : 9,237,771 B2
APPLICATION NO. : 14/605735
DATED : January 19, 2016
INVENTOR(S) : Paperno It is certified that error appears in the above-identified patent and that said Letters Patent is hereby corrected as shown below:

In the specification

Column 1, line 19, delete "new born" and insert --newborn--, therefor.

Column 4, line 45, after "15" insert --.--.

Column 4, line 53, after "device" insert --.--.

Column 4, line 55, after "device" insert --.--.

Column 9, line 7, please delete "3000N" and insert --300 ON--, therefor.

Column 10, line 1, delete "4000N" and insert --400 ON--, therefor.

In the claims

Column 18, line 64, Claim 10, delete "claim 8," and insert --claim 9,--, therefor.

Signed and Sealed this
Second Day of August, 2016

Michelle K. Lee

Michelle K. Lee
*Director of the United States Patent and Trademark Office*